US005107705A

United States Patent [19]

Wraight et al.

[11] Patent Number: 5,107,705

[45] Date of Patent: Apr. 28, 1992

[54] VIDEO SYSTEM AND METHOD FOR DETERMINING AND MONITORING THE DEPTH OF A BOTTOMHOLE ASSEMBLY WITHIN A WELLBORE

[75] Inventors: Peter Wraight, Missouri City; James C. Mayes; Jacques Orban, both of Sugar Land, all of Tex.

[73] Assignee: Schlumberger Technology Corporation, Houston, Tex.

[21] Appl. No.: 502,073

[22] Filed: Mar. 30, 1990

[51] Int. Cl.[5] ..... F21B 45/00

[52] U.S. Cl. ..... 73/151.5; 358/139; 364/562

[58] Field of Search ..... 73/151.5; 358/105, 107, 358/139, 10; 364/562

[56] References Cited

U.S. PATENT DOCUMENTS

| | | | |
|---|---|---|---|
| 2,166,212 | 7/1939 | Hayward . | |
| 2,221,767 | 11/1940 | Hayward et al. . | |
| 2,287,819 | 6/1942 | Nichols . | |
| 3,651,871 | 3/1972 | Greene . | |
| 3,853,004 | 12/1974 | Westlake et al. . | |
| 3,931,735 | 1/1976 | Guigmard . | |
| 4,114,435 | 9/1978 | Patton et al. . | |
| 4,312,223 | 1/1982 | Koch . | |
| 4,338,565 | 7/1982 | Hall . | |
| 4,575,751 | 3/1986 | Duschl | 358/139 |
| 4,610,005 | 9/1986 | Utasi . | |
| 4,616,321 | 10/1986 | Chan . | |
| 4,756,188 | 7/1988 | Fennell . | |
| 4,787,244 | 11/1988 | Mikolajczyk . | |
| 4,852,052 | 7/1989 | Frey et al. . | |
| 4,924,307 | 5/1990 | Landowski et al. | 358/139 |

FOREIGN PATENT DOCUMENTS 2205980 12/1988 United Kingdom .

*Primary Examiner*—Hezron E. Williams
*Assistant Examiner*—Craig Miller
*Attorney, Agent, or Firm*—John J. Ryberg

[57] ABSTRACT

Video systems and methods for determining the length of objects to be inserted in a wellbore, and for summing the lengths to obtain an accurate determination of the depth at which a bottomhole assembly is located at any given time. The video systems and methods of the present invention are also used in conjunction with hook-load and traveling block location information to determine bottomhole assembly depth while drilling, or tripping-in or tripping out of a well. Also disclosed is a method of accurately determining the transition a drill-string undergoes and its associated movement when passing from in-slips to out-of-slips.

20 Claims, 11 Drawing Sheets

FIG. 2
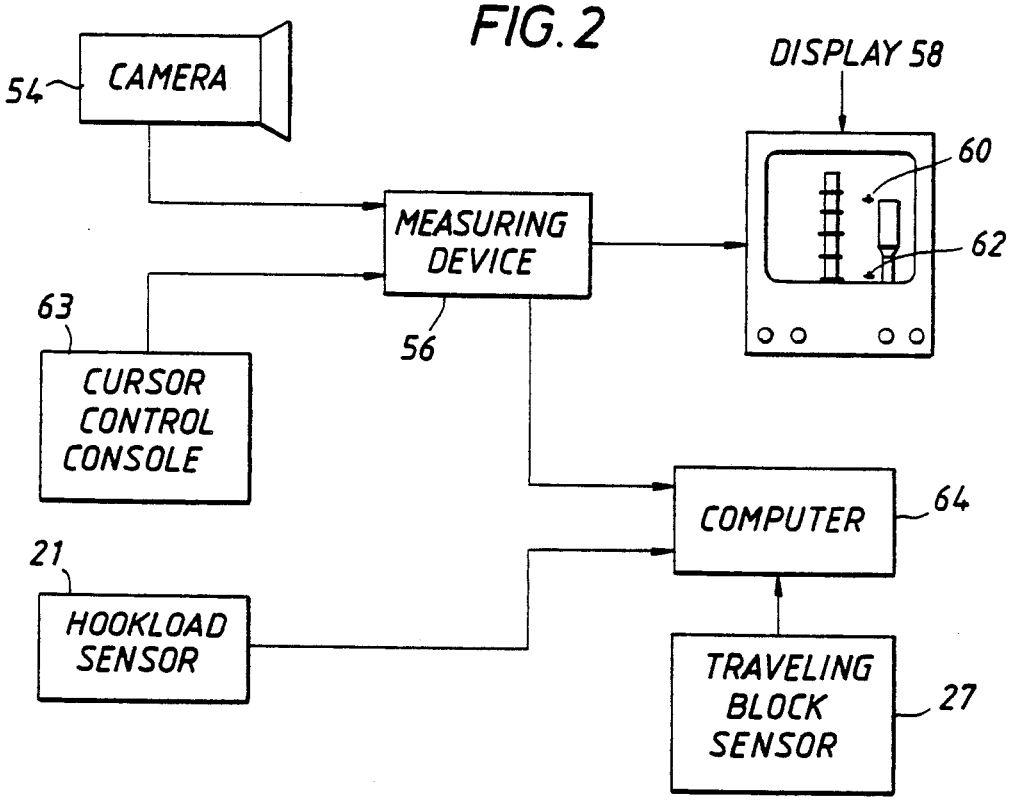
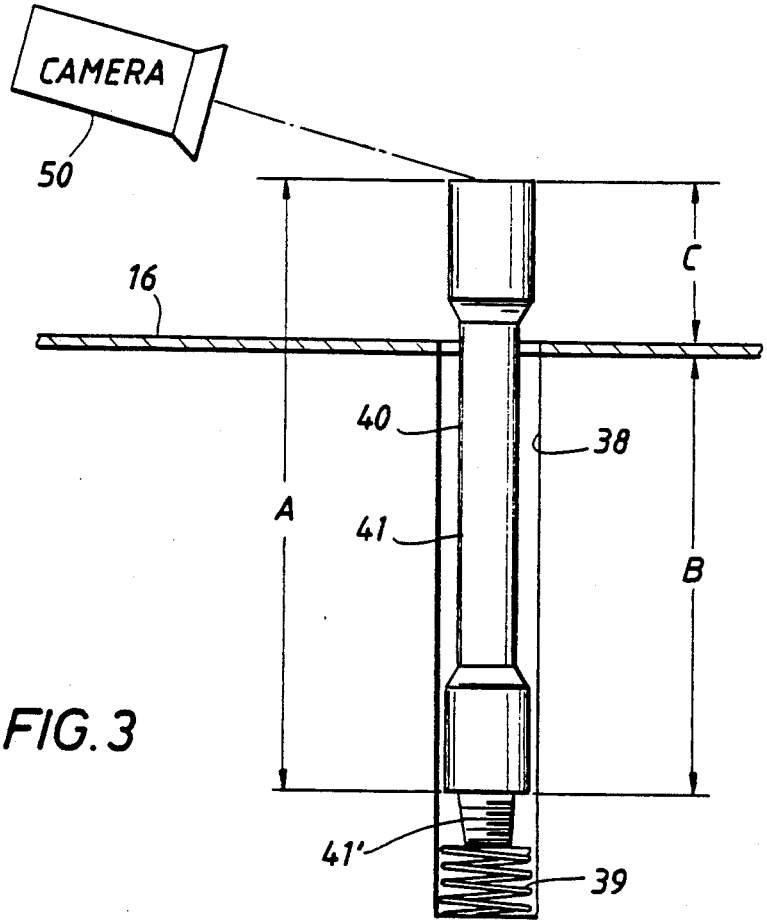
FIG. 3

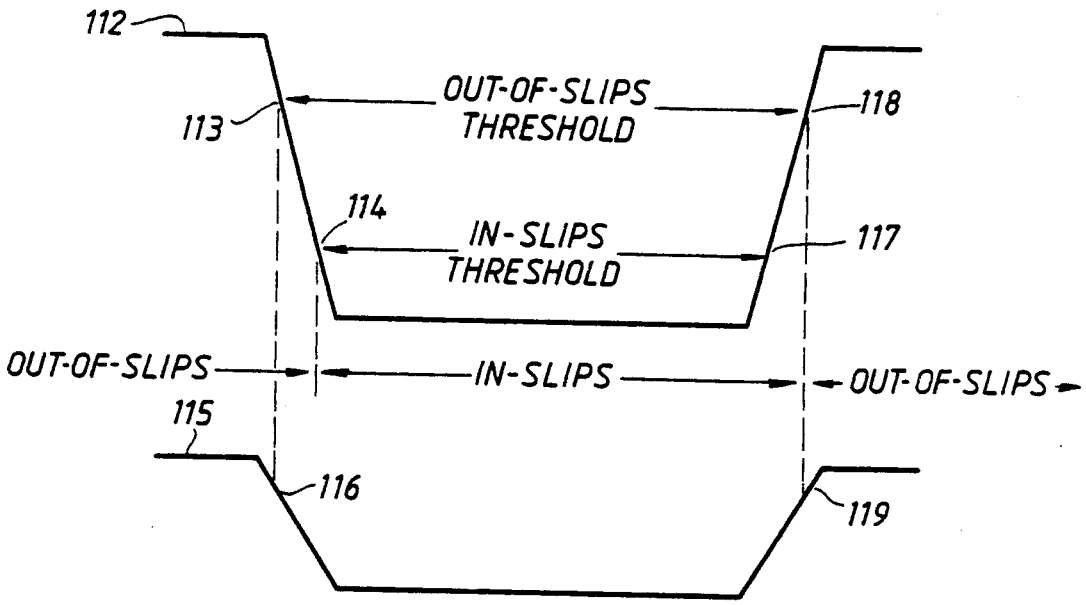
FIG. 11
FIG. 12A
| SAMPLE | HOOKLOAD | TBA |
|---|---|---|
| 6 | 91 Klbs | 76.00 Ft. |
| 5 | 89 | 75.98 |
| 4 | 88 | 75.96 |
| 3 | 87 | 75.94 |
| 2 | 86 | 75.92 |
| 1 | 85 | 75.90 |
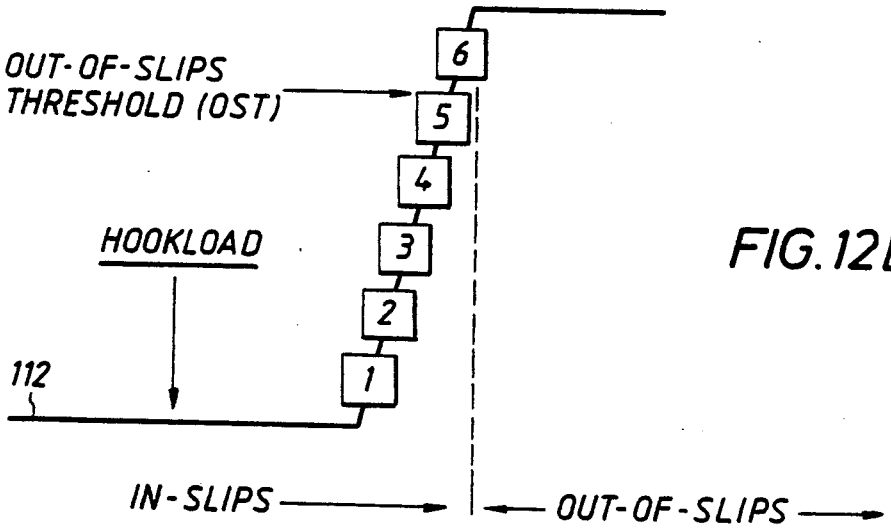
FIG. 12B

VIDEO SYSTEM AND METHOD FOR DETERMINING AND MONITORING THE DEPTH OF A BOTTOMHOLE ASSEMBLY WITHIN A WELLBORE

TECHNICAL FIELD

The present invention relates to systems and methods for determining and monitoring the depth at which a drilling rig is operating, and more particularly relates to systems and methods for determining and monitoring the depth at which a bottomhole assembly is located within a wellbore. The present invention further relates to systems and methods for accurately determining the length of an object before it is placed in a well.

BACKGROUND OF THE INVENTION

In common rotary drilling methods and systems used in drilling oil field boreholes, power rotating means delivers torque to a drill pipe, a plurality of which forms a drill string, via a kelly and a rotary table. The drill string in turn rotates a bit located at its lowermost end that drills a borehole through the sub-surface formation. The drill string is supported for up and down movement by a drilling mast located at the earth's surface. A drill line or cable supported by the drilling mast and coupled to the drill string is used in conjunction with a rotating drum to facilitate the up and down movement. The drill line is anchored at one end called the dead line anchor, which is typically located adjacent to one leg of the drilling mast. The drill line extends from the anchor upwardly to a crown block formed of a plurality of rotatable sheaves at the top of the mast. The drill line is reaved around the sheaves in the crown block and extends downwardly between the crown block sheaves and rotating sheaves in a traveling block. The drill line then extends from the crown block downward to a rotating drum or drawworks. that moves the crown block up and down by reeling the drill line in or out.

As will be appreciated by those skilled in the art, determining and monitoring the depth at which a component of the bottomhole assembly (BHA) is located at any given time in a wellbore is important for many reasons. For example, the drilling rig operator needs to know the depth at which the bottom hole assembly is located during trips in and out of the well so that he can be cautious when passing through sensitive zones such as bridges, ledges, or key seats. In addition, by correlating information gathered from offset wells, a driller needs accurate depth measurement information while drilling subsurface formations to anticipate trouble zones, e.g., high gas-pressured gas zones, in order to take appropriate precautionary measures. Also, accurate depth information is extremely valuable when performing directional or horizontal drilling operations.

In recent years, many developments have been made in the area of gathering borehole data while the drilling operation is being conducted. These services, which are commonly referred to as measurement-while-drilling (MWD), logging-while-drilling (LWD), and formation evaluation while drilling (FEWD), typically incorporate various sensing devices into the bottomhole assembly to gather information related to, for example, formation lithography, downhole environment, and tool operating parameters. The raw or processed data gathered by such devices are typically either transmitted to the surface in "real time" by using, for example, a mud pulse telemetry system, or stored in a memory device located in the downhole tool for later retrieval when the BHA is brought back to the earth's surface, or simultaneously transmitted in real time and stored downhole. For much of this information to be of significant value, particularly lithography data, it must be correlated to the particular depth at which the information was obtained. Accordingly, it is extremely important for MWD or LWD service providers to have an accurate depth measurement system and apparatus.

Present day depth systems and methods typically include a combination of keeping a tally indicating the length of each drill pipe inserted into the borehole, and measuring the incremental length of the last drill pipe being lowered into the borehole during the drilling or tripping operation by monitoring the movement of the traveling block. Traveling block movement is commonly determined by monitoring the motion of the drilling line as it is fed from the drawworks, e.g., with a sensor coupled to the rotating drum or one of the sheaves in the crown block. This general type of system, however, contains many sources of errors and inaccuracies. For example, the length of a particular pipe section is simply inaccurately measured or noted erroneously, or added to the drill string in an order different from that noted in the tally. In addition, with respect to monitoring the motion of the drilling line through drum rotation to record the length of the last pipe, since the drill line cable stretches over time and because the cable is wound in layers around the rotating drum, the rotation of the drum itself does not accurately correlate to the length of the last drill pipe being lowered.

Further inaccuracies with prior methods typically occur during the procedure when pipe is added or subtracted to the drill string either while conducting the drilling operation or while tripping in or out of the well. For example, when the rig's traveling block has reached its maximum downward movement during a drilling operation and a new section of pipe must be added, the traveling block and connected drill string are first raised a short distance by reeling in the drill line cable, followed by placing slips in the rotary table. After the slips are inserted, the traveling block is lowered a short distance such that the slips support the drill string, which allows the kelly to be unscrewed. In the process, cable is reeled out while the BHA remains stationary. The disparity in movement is due to the release of tension in the cable since the cable is no longer supporting the weight of the drill string. On the other end of the procedure when the kelly is swung over to the pipe and the new pipe is attached onto the kelly, and the kelly and new pipe are swung back and attached to the drill string, the traveling block first moves upward to a point where the slips can be removed. When the slips are removed, again misallocations regarding drum rotation and traveling block movement with respect to the drill string movement are made with resulting depth determination inaccuracies. These small errors at each transition can translate into an accumulated error of several feet during the course of drilling a well.

An additional problem with tracking BHA position based on traveling block altitude is that such systems, for a variety of reasons, often loose track of the block position. Systems that determine block position based on encoders connected to the drawworks loose block position accuracy, for example, because of cable stretch over time and changes in the way the cable wraps on the drumwork's rotating drum. Systems that place encoders on the fast sheave in the crown block typically loose block position accuracy, for example, because of cable slippage and cable stretch. Both of these general types of systems typically lack a reliable way of resetting block position that does not affect or interfere with the drilling operation.

In order to overcome some of the inaccuracies inherent in most prior art depth techniques, several different methods and apparatus have been proposed. For example, in U.S. Pat. No. 4,114,435 to Patton et al, it is proposed to measure different traveling block reference points that relate to when the cable on the drawwork drum reaches different layers of unwinding, and then to determine the location of the traveling block via an equation, the reference points, the rotation of the drum, etc. The Patton et al system, however, still provides inaccuracies because it fails to account for the dynamic nature of the cable layering process. Moreover, an account for the cable stretching over time is not provided for.

U.S. Pat. No. 4,787,244 to Mikolajczyk proposes to automatically determine the drill bit depth by tracking the movement of the cable. Movements of the cable are only tracked when the weight carried by the traveling block exceeds a certain minimum threshold as determined by a tensiometer on a cable. However, this prior technique fails to account properly for movements of the cable during the slips-in and slips-out procedure when the transition is made through the threshold. Similar types of errors are believed to be inherent in the system proposed in U.S. Pat. No. 4,616,321 to Chan.

U.S. Pat. No. 4,610,005 to Utasi proposes a video system that monitors the position and movement of the traveling block to determine borehole depth. In Utasi's system, a video camera is positioned to track the vertical movement of the traveling block. However, Utasi's systems seems to be fairly impractical and inaccurate because of the remote distance that the camera must be positioned to view the entire rig. In addition, the distance between the camera and the rig renders the system susceptible to interference from the rig structure, lighting changes, equipment movement, etc.

In light of the above, a principal object of the present invention is to provide a system for and method of accurately determining and monitoring the depth at which a bottomhole assembly is located within a wellbore.

A further object of the present invention to provide a system for and method of accurately measuring and recording the length of an object before it is inserted into a well.

Another object of the present invention is to provide a means for verifying and resetting a depth determination to substantially reduce accumulated errors.

A further object of the present invention is to provide a system for and method of accurately measuring and recording the depth at which a bottomhole assembly is located while substantially not affecting or interfering with the normal operation of a drilling rig and its crew.

SUMMARY OF THE INVENTION

The present invention provides systems for and methods of accurately determining the length of an object before it is inserted in a wellbore, and accurately determining the depth at which a bottomhole assembly is located within a wellbore. In a preferred embodiment of the present invention, a video camera is positioned near the rig floor and focused above the mouse hole. The camera is associated with a video display having moveable cursors superimposed thereon by a measuring device. After the measuring device associated with the camera and video display has been calibrated to build a table of pixel distance between cursor position versus length within a computer, the length of an object placed within the mouse hole, e.g., a section of drill pipe, is determined by moving the cursors on the video display adjacent to the image of the portion of the object protruding from the mouse hole, and equating the pixel distance between the cursors to a length based upon the pixel distance/length table. This length is added to the previously-determined length that pipes extend below the rig floor into the mouse hole to obtain the object's overall length. The computer is programmed to sum up the total length of pipes added to the drillstring via the mousehole during either drilling or tripping operations.

In another preferred embodiment of the present invention, two cameras are positioned on a rig to measure the length of joints suspended within the rig's mast as they are added to or subtracted from a drillstring. Both cameras and the images displayed thereby on a video display and the measuring device associated therewith are calibrated to generate a pixel distance versus length table which is used in determining the length of added or subtracted joints, which are summed by the computer in determining depth.

In other preferred embodiments of the present invention, traveling block movement and position information and hookload information are used to determine depth with the video systems being used in association therewith to verify the accuracy thereof and provide the basis for making resets and offsets when necessary.

BRIEF DESCRIPTION OF THE DRAWINGS

While the specification concludes with claims particularly printing out and distinctly claiming the subject matter regarded as forming the present invention, it is believed that the invention will be better understood and appreciated from the following detailed description and drawings in which:

FIG. 2 is a schematic block diagram of the main components of one preferred system of the present invention;

FIG. 3 is a schematic side view of a mouse hole having a drill pipe section inserted therein and showing the lengths to be determined in one embodiment of the present invention;

FIG. 11 is a graph of hookload and traveling block altitude versus time during a typical slips transition;

FIG. 12 is a graph of hookload and traveling block altitude versus time showing only the in-slips to out-of-slips transition with Table 1 illustrating a specific example of the out-of-slips look back (OSLB) calibration process of the present invention;

DETAILED DESCRIPTION OF THE INVENTION

Figure 1:
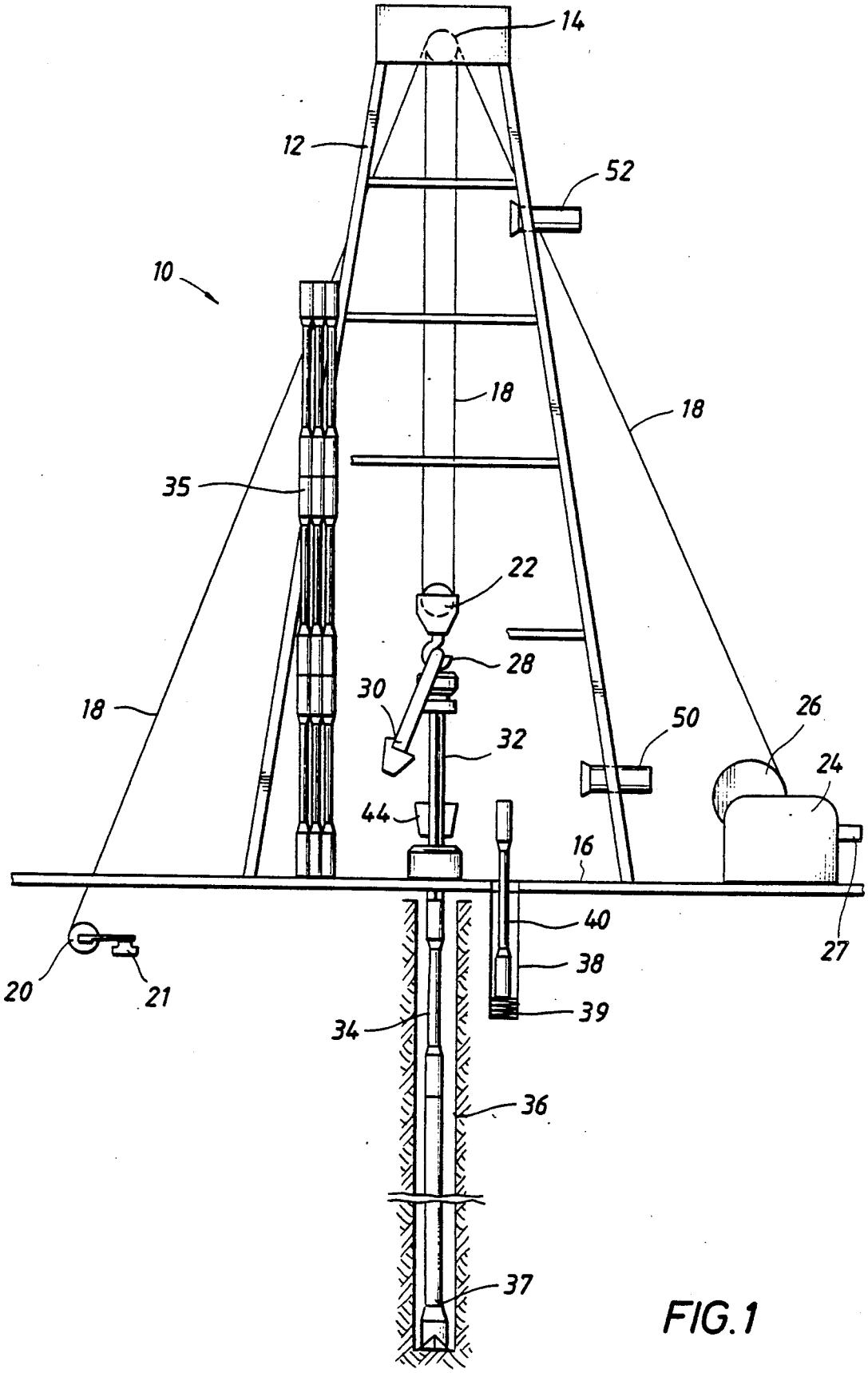
FIG. 1 is a schematic side view of a typical drilling rig and borehole which illustrates the general environmental in which the present invention finds particular utility.

The depth determining and monitoring systems and methods of the present invention may be used and practiced in association with a wide variety of drilling rigs that are commonly used in the industry, for example, on-shore, off-shore, floating platforms, rotary table drives, top drives, mud motor drives, etc. In addition, the systems and methods of the present invention may be used to determine and sum the lengths of any objects as they are placed within a wellbore, e.g., drill pipe, drill collars, MWD subs, tubing, casing, etc. With reference to the Figures in which the same numeral is used to indicate common apparatus and application components, FIG. 1 schematically illustrates a typical drilling rig generally indicated as 10 that is representative of most rigs commonly used in the art. In FIG. 1, rig 10 includes a vertical derrick or mast 12 having a crown block 14 at its upper end and a horizontal rig floor 16 at its lower end. Drill line 18 is fixed to deadline anchor 20, which is commonly provided with hook load sensor 21, and extends upwardly to crown block 14 having a plurality of sheaves (not shown). From block 14, drill line 18 extends downwardly to traveling block 22 that similarly includes a plurality of sheaves (not shown). Drill line 18 extends back and forth between the sheaves of crown block 14 and the sheaves of traveling block 22, then extends downwardly from crown block 14 to drawworks 24 having rotating drum 26 upon which drill line 18 is wrapped in layers. The rotation of drum 26 causes drill line 18 to be taken in or out, which raises or lowers traveling block 22 as required. Drawworks 24 may be provided with sensor 27 which monitors the rotation of drum 26. Sensor 27 may be, for example, a quadrature incremental encoder that produces pulses as drum 26 rotates as is well known in the art. Alternatively, sensor 27 may be located in crown block 14 to monitor the rotation of one or more of the sheaves therein.

Hook 28 and elevators 30 are attached to traveling block 22. Hook 28 is used to attach kelly 32 to traveling block 22 during drilling operations, and elevators 30 are used to attach drill string 34 to traveling block 22 during tripping operations. Drill string 34 is made up of a plurality of individual pipe members, a grouping of which are typically stored within mast 12 as joints 35 (singles, doubles, or triples) in a pipe rack. Drill string 34 extends down into wellbore 36 and terminates at its lower end with bottom hole assembly (BHA) 37 that typically includes a drill bit, several heavy drilling collars, and instrumentation devices commonly referred to as measurement-while-drilling (MWD) or logging-while-drilling (LWD) tools. Mouse hole 38, which typically has spring 39 at the bottom thereof, extends through and below rig floor 16 and serves the purpose of storing next pipe 40 to be attached to drill string 34.

During a drilling operation, power rotating means (not shown) rotates a rotary table (not shown) having rotary bushing 42 releasably attached thereto located on rig floor 16. Kelly 32, which passes through rotary bushing 42 and is free to move vertically therein, is rotated by the rotary table and rotates drill string 34 and BHA 37 attached thereto.

During the drilling operation, after kelly 32 has reached its lowest point commonly referred to as the "kelly down" position, new pipe 40 in mouse hole 38 is added to drill string 34 by reeling in drill line 18 onto rotating drum 26 until traveling block 22 raises kelly 32 and the top portion of drill string 34 above rig floor 16. Slips 44, which may be manual or hydraulic, are placed around the top portion of drill string 34 and into the rotary table such that a slight lowering of traveling block 22 causes slips 44 to be firmly wedged between drill string 34 and the rotary table. At this time, drill string 34 is "in-slips" since its weight is supported thereby as opposed to when the weight is supported by traveling block 22, or "out-of-slips".

Once drill string 34 is in-slips, kelly 32 is disconnected from string 34 and moved over to and secured to new pipe 40 in mouse hole 38. New pipe 40 is then hoisted out of mouse hole 38 by raising travelling block 22, and attached to drill string 34. Traveling block 22 is then slightly raised which allows slips 44 to be removed from the rotary table. Traveling block 22 is then lowered and drilling resumed.

"Tripping-out" is the process where some or all of drill string 34 is removed from Wellbore 36. In a trip-out, kelly 32 is disconnected from drill string 34, set aside, and detached from hook 28. Elevators 30 are then lowered and used to grasp the uppermost pipe of drill string 34 extending above rig floor 16. Drawworks 24 reel in drill line 18 which hoists drill string 34 until the section of drill string 34 (usually a "triple") to be removed is suspended above rig floor 16. String 34 is then placed in-slips, and the section removed and stored in the pipe rack. "Tripping-in" is the process where some or all of drill string 34 is replaced in wellbore 36 and is basically the opposite of tripping out.

In some drilling rigs, rotating the drill string is accomplished by a device commonly referred to as a "top drive" (not shown). This device is fixed to hook 28 and replaces kelly 32, rotary bushing 42, and the rotary table. Pipe added to drill string 34 is connected to the bottom of the top drive. As with rotary table drives, additional pipe may either come from mouse hole 38 in singles, or from the pipe racks as singles, doubles, or triples.

The depth of a component of the BHA, whether the bit or an MWD device for example, during the drilling operation at any instant in time is the sum of the distance between the lower edge of the lowermost pipe of drillstring 34 to the BHA component, the total length of drill string 34, and the length of the portion of kelly 32 extending below rig floor 16, which is typically the reference point or "zero" for all depth determinations. The depth of a component of the BHA while tripping in or out of a well is the total of the distance between the lower edge of the lowermost pipe of drillstring 34 to the BHA component, plus the total length of drill string 34, minus the portion of the uppermost pipe extending above rig floor 16. The depth determination and monitoring systems and methods of the present invention accurately determine the depth of a BHA component during drilling or while tripping in or out of wellbore 36.

In one preferred embodiment of the present invention and still referring to FIG. 1, lower camera 50 is positioned within the lower portion of mast 12 of rig 10 on or near rig floor 16 such that its field of view is directed to the rotary table and the top of drill string 34 extending above the rotary table when present. The field of view of lower camera 50 is also preferably directed to the upper portion of next pipe 40 stored within mouse hole 38 that extends above drilling floor 16. On some drilling rigs, it might not be possible or practical to position lower camera 50 such that its field of view is directed to both the rotary table and the mouse hole. In such instances, two lower camera units are preferably used. In another preferred embodiment of the present invention to be described in greater detail later herein, upper camera 52 is located in the upper portion of mast 12 and positioned such that its field of view is directed to where the top edge of a joint 35 would be located during a tripping operation.

FIG. 2 schematically illustrates the main components of the video depth determination systems of the present invention. Camera 54 represents any one of the cameras used in the present invention and located on the rig, whether it be lower rotary table/mouse hole camera 50, upper camera 52, or a separate rotary table camera and a mouse hole camera. Camera 54 may be of any standard video format, black and white or color, such as model No. WVBL202 available from Panasonic. Camera 54 acquires an image of the object to be measured and supplies a corresponding video signal to measuring device 56 such as that available from Boeckeler Instruments, Inc., model number VIA 100. Measuring device 56 displays the image received from camera 54 on video screen or display 58 such as model No. VM4509 available from Sanyo, and superimposes moveable cursors 60 and 62 thereon. The location of cursors 60 and 62 on video display 58 is independently controlled by an input signal to measuring device 56 from control console 63. The distance between cursors 60 and 62 appearing on video display 58 is measured in pixels by measuring device 56 and supplied to computer 64, which may be any computing device capable of accepting data from measuring device 56 and making the required computations. Computer 64 may be any computer, microcomputer, microprocessor, microcontroller, etc. such as an N286 available from ACUDATA, Inc. of Houston, Tex. U.S.A. In an alternate embodiment, measuring device 56 superimposes only one moveable cursor on disply 58, which in operation is functionally equivalent to the two cursor embodiment shown in FIG. 2.

In making depth determinations with a particularly preferred embodiment of the systems and methods of the present invention to be described hereinafter in greater detail, the position and movement of traveling block 22 and hookweight or hookload are preferably obtained and imputed into computer 64. Hookweight measurements are made by hookload sensor 21 located, for example, in conjunction with deadline anchor 20 as shown in FIG. 1 although as those skilled in the art will appreciate, hookload may be measured at any one of many locations such as at hook 28, in crown block 14, on drill line 18 etc. The position and movement of traveling block 22 may be obtained from traveling block sensor 27 such as a drawworks sensor that monitors the rotation of drum 26 as drill line 18 is reeled in and out of drawworks 24. Traveling block sensor 27 may be, for example, an encoder directly or indirectly attached to the rotating shaft of rotating drum 26 as is presently known in the art. Alternatively, block position and movement may be determined by a sensor located in crown block 14 that monitors the rotation of one or more of the sheaves therein, or monitors the movement of drill line 18 as it passes through the crown block 14 or near drawworks 26. As noted previously herein, determining depth based upon traveling block location by monitoring movement of drill line 18 and monitoring hookload alone as presently done in the art is replete with sources of error that individually or cumulatively result in inaccurate depth measurements. However, the video depth systems and methods of the present invention are equipped with means for detecting and substantially eliminating these errors as will be hereinafter explained in greater detail.

Figure 4:
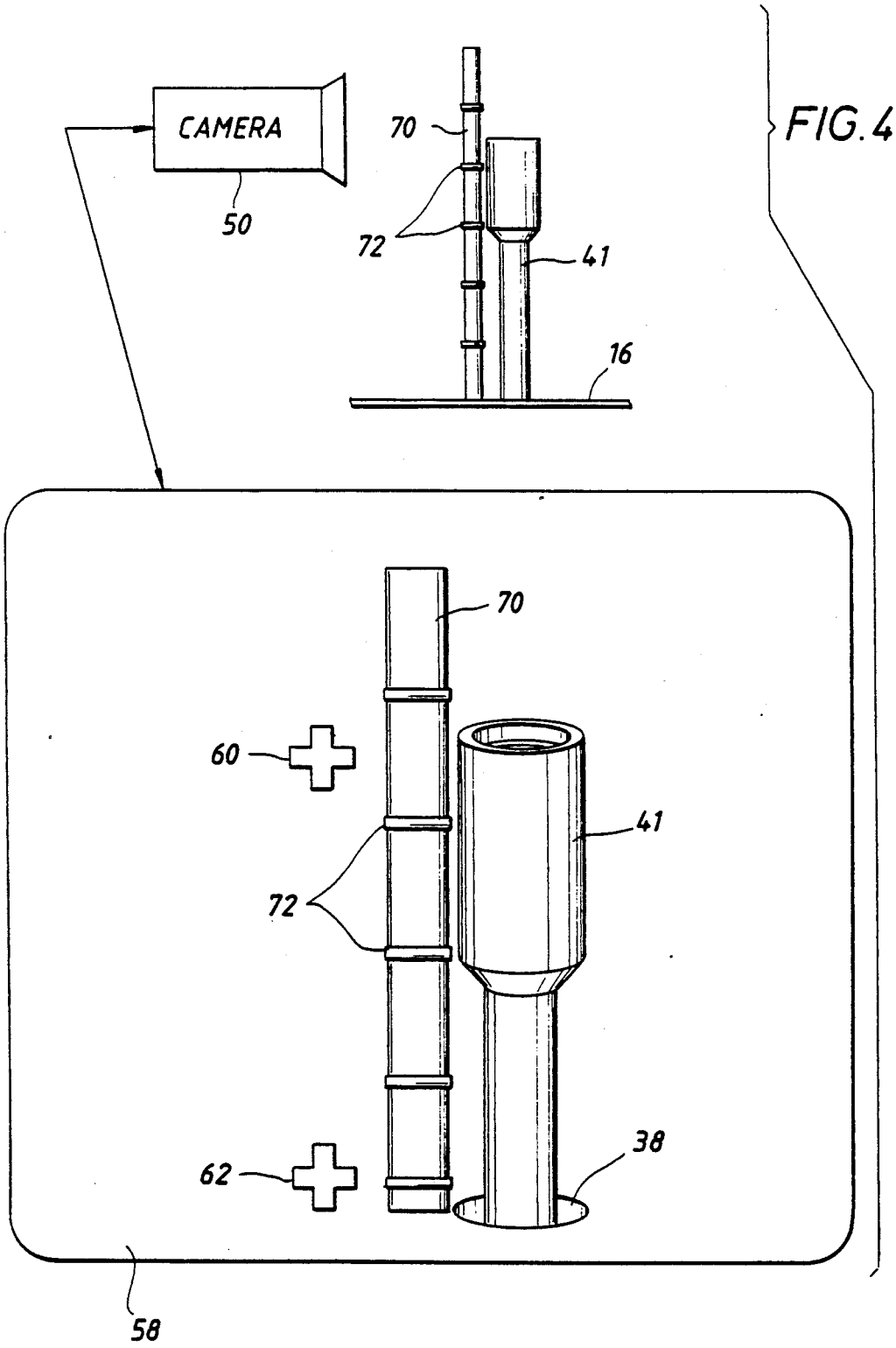
FIG. 4 is a schematic side view of the top portion of a drill pipe section extending out of a mouse hole above a rig floor and the image thereof recorded on a display.

When determining depth while drilling or tripping, it is important to accurately measure the length of a pipe being added to or subtracted from the drillstring and keeping an accurate record of the length of each of these pipe sections. FIGS. 3 and 4 illustrate the procedure of a preferred embodiment of the present invention that uses lower camera 50 for measuring the length of next pipe section 40 located within mousehole 38 to be added to drillstring 34, or that was removed from drillstring 34. Briefly, the procedure includes a calibration step and an actual measuring step. The calibration procedure produces the length that pipes extend below rig floor 16 and into mouse hole 38 when a pipe is placed therein that loads spring 39 (if present), and a table of coefficients used to measure the section of the pipe extending above the rig floor. The total length of pipe 40 mouse hole 38 is then obtained by adding the two lengths together.

First referring to FIG. 3, face-to-face length "A" of any pipe placed within mouse hole 38 is equal to length "B" of the pipe extending below rig floor 16 excluding the length of male thread 41', plus length "C" that the pipe extends above rig floor 16. Since the length of male threads or "pin" 41' of all pipes to be measured is fairly constant and held to a tolerance set by the API, this length is ignored. In the first step of the calibration procedure, total face-to-face length A of reference or calibration pipe 41 is accurately measured before it is placed in mousehole 38 with a steel tape, for example, and entered into computer 64. When pipe 41 is placed within mousehole 38, the weight thereof loads and compresses spring 39, and since spring 39 is very rigid, all subsequent pipes placed within mousehole 38 will compress spring 39 approximately the same amount. Then, with reference to FIG. 4, after reference pipe 41 is placed in mousehole 38, calibration rod 70 having a plurality of calibration marks 72 thereon is placed adjacent to the upper portion of pipe 41 extending above rig floor 16, both pipe 41 and rod 70 preferably being approximately the same distance away from lower camera 50. In a preferred embodiment, marks 72 on rod 70 are spaced an equal distance from one another, e.g., 0.5 feet (15.25 cm), the number and spacing of marks 72 depending on the degree of accuracy desired to overcome the apparent displacement of non-equidistant objects associated with camera 50.

The image recorded by camera 50 is displayed on display 58 which has superimposed thereon reference cursor 62 and measurement cursor 60 by measuring device 56 as shown in FIG. 4. From control console 63, reference cursor 62 is moved and placed where calibration rod 70 contacts rig floor 16 and remains in this position during both the calibration and length measurement procedures. Measurement cursor 60 is then first placed over or adjacent to the next mark 72 on rod 70 up from rig floor 16. When so placed, an entry is made on control console 63 which sends a signal to computer 64 through measuring device 56 to determine the number of pixels between cursors 60 and 62 and to equate that number to the known distance the between the bottom and first marks 72 on rod 70. Measurement cursor 60 is then moved up through each successive mark 72 on rod 70 and signals are sent to computer 64 at each point. Once all marks 72 on rod 70 have been recorded in this fashion (or as many marks as accuracy requires and time and circumstances permit), computer 64 has compiled a table of pixel distance between cursors 62 and 60 versus length, or actual height above rig floor 16 in this case. In an alternate form of the present invention, display 58 has only one moveable cursor superimposed thereon by measuring device 56, which functionally is the same as the two cursor embodiment just described by the one cursor serving as both a reference cursor in one mode and as a measurement cursor in the other mode.

In the final calibration step, measurement cursor 60 is placed adjacent to the top edge of pipe 41 as shown on display 58 in FIG. 4. Based on imput from measuring device 56, computer 64 then equates the pixel distance between reference cursor 62 and measurement cursor 60, which corresponds to length C (FIG. 3) of pipe 41 extending above rig floor 16, to a length (feet or meters and fractions thereof) by using the earlier-generated pixel distance versus length table. A linear interpolation, a curve fitting algorithm, or any similar algorithm known to those skilled in the art can be used to solve for points that fall between the calibration points. In this manner, length C (FIG. 3) is obtained, which is subtracted from earlier-determined total length A of pipe 41 to determine length B of the pipe extending below rig floor 16. Length B is stored in computer 64 for future use.

The video system of the present invention illustrated in FIG. 4 is then fully calibrated and ready to accurately measure and automatically tally the length of each new pipe 40 of unknown length before it is added to drillstring 34, or after it is removed therefrom, via mouse hole 38. In the measurement procedure, after a pipe is placed in mouse hole 38, measurement cursor 60 is lined up with the very top edge of the pipe with reference cursor 62 remaining where it was placed during the calibration procedure, and an entry is made in control console 64. From the pixel distance versus length table generated during the calibration procedure and stored in computer 64, computer 64 equates the distance between cursors 62 and 60 into a length, and then adds the previously-determined and stored length B of mousehole extension thereto, which gives the total face-to-face length of the pipe about to be added to drillstring 34. Each time the length of a new pipe is measured in this fashion and the pipe is added to drillstring 34, an entry is made on control console 64 which through measuring device 56, updates a summation program in computer 64 to add the new length to a running total length. Alternatively, each time a pipe is removed from drillstring 34 and the length thereof determined as just described, an entry is made on control console 64 which through measuring device 56, updates a subtraction program in computer 64 to subtract the length of the removed pipe from the running total length. In a preferred embodiment, the total length of all pipes making up drillstring 34 is displayed on display 58, and also recorded on tape for playback if desired.

In an alternate version of the embodiment of the present invention just described, measurement device 56 is replaced with a video digitizer equipped with digitization software such as a TARGA M8 available from Dawson and Associates of Houston, Tex. U.S.A. In this alternate embodiment, the video digitizer is resident on the computer 64 bus, for example, or as a component separate from computer 64 as with measuring device 56. The image recorded by the camera is digitized, written to the computer's videomemory, and displayed on the display or screen associated with the computer along with cursors also generated by the digitization software. The software moves the cursors upon operator command and determines the pixel distance between the cursors as was done in the measurement device embodiment.

The calibration and measurement procedures from an operator viewpoint are basically the same.

Another implementation of this alternate embodiment automates the measurement procedure with computer 64 making the measurement with little or no operator input. Specifically, a map, for example, representing the approximate shapes of calibration rod 70 and the objects to be measured are stored in computer 64. During the calibration procedure, calibration rod 70 is placed the same as previously described. Computer 64 recognizes its basic shape as well as each calibration marking 72 thereon and stores the pixel location of each mark 72 in its memory. Computer 64 then uses the pixel distance between each mark 72 along with its previous knowledge of the distance between each marking to generate a pixel distance versus length table as previously described.

Reference pipe 41 is placed in mousehole 38 and its total length entered into computer 64. The computer then examines and recognizes the section of pipe 41 extending above rig floor 16 and uses the image in determining the length thereof with the pixel distance versus length table, and solves for length B of FIG. 4. Thereafter, computer 64 through image recognition determines the length of any pipe in mousehole 38 as previously described. In instances where a confusing background might undermine or interfere with the ability of computer 64 to recognize shapes and outlines of object, a constant shade backdrop or backlight is preferably used.

In another preferred embodiment of the present invention, the length of single, double, or triple joints 35 stored in the pipe racks of rig 12 may be accurately measured and tallied as they are added to or subtracted from drilling 34 either while tripping with a rotary table drive rig, or when adding pipe during drilling or tripping with a top drive rig. Referring briefly to FIG. 1, upper camera 52 is positioned in the upper portion of mast 12 and is used in conjunction with lower camera 50 to make the required length measurements. As with the previous embodiment used to measure the length of a pipe in mousehole 38, the pipe rack embodiment of the present invention includes first a calibration step followed by the actual measurement steps, either in digitized or non-digitized format.

Figure 5A:
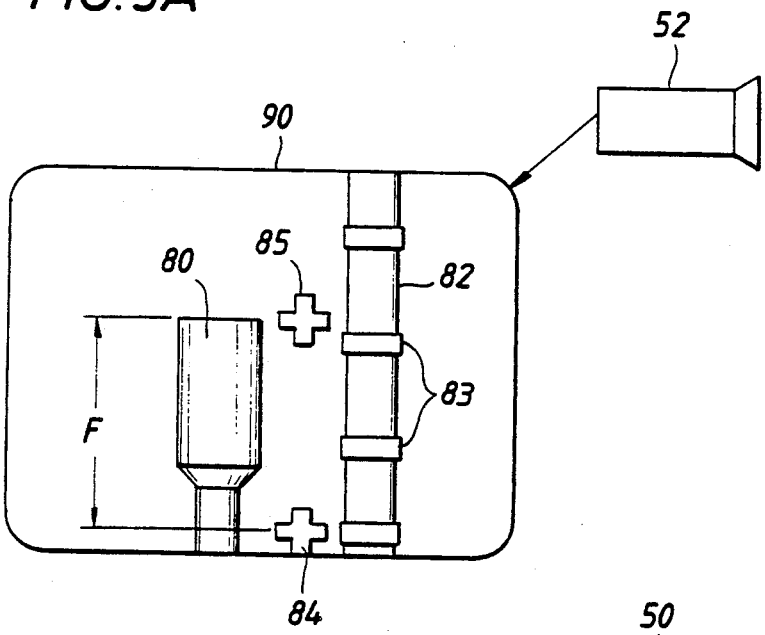
FIG. 5 is a schematic side view of a drill pipe joint suspended in a rig and images thereof recorded on two displays.
Figure 5C:
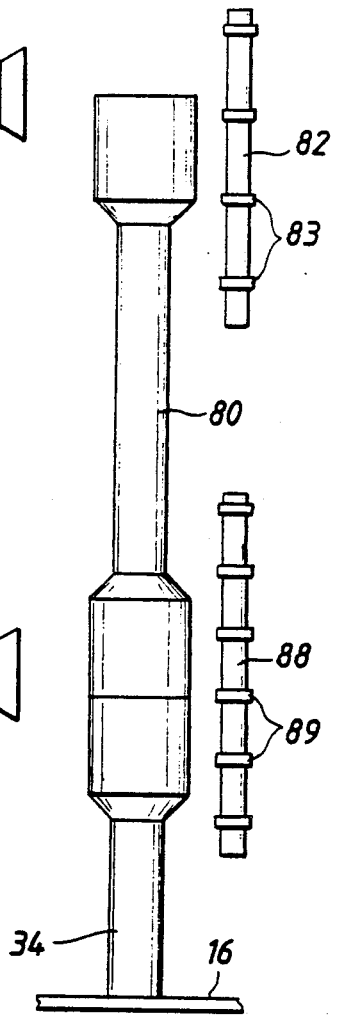
Figure 5B:
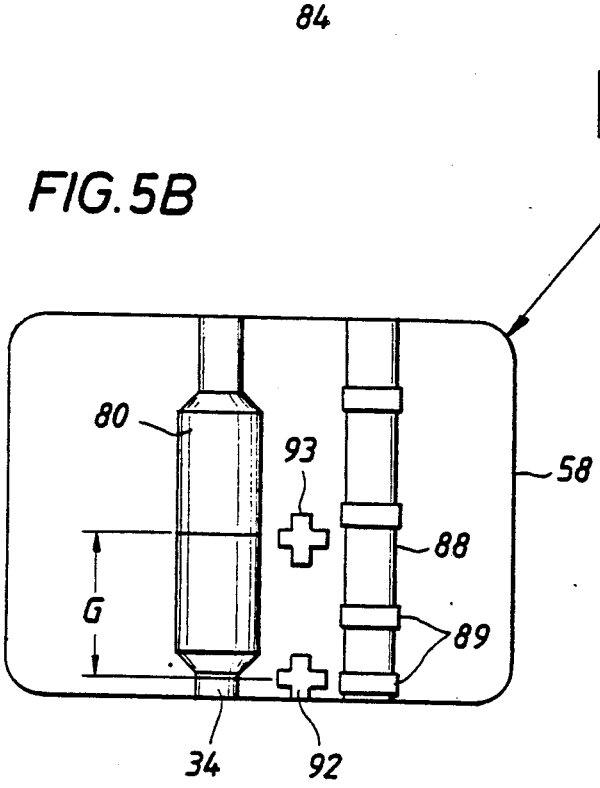

FIG. 5 illustrates the calibration procedure used for the two camera embodiment of the present invention, which will generate two separate tables of pixel distance versus length in computer 64, one for each camera. In calibrating the system, upper camera 52 is focused on the upper portion of reference pipe 80, which may be a single, double, or triple, that has been previously measured by any accurate technique such as by hand with a steel tape, or with the previously-described mousehole embodiment as reference pipe 80 is assembled and attached to the portion of drillstring 34 extending above rig floor 16. Calibration rod 82, which is essentially identical to previously-described rod 70 and includes a plurality of markings 83 thereon, is positioned adjacent to the upper portion of reference pipe 80 such that both the top portion of pipe 80 and rod 82 are within the field of view of upper camera 52 and preferably being approximately the same distance away from camera 52. The view recorded by upper camera 52 is displayed on display 90 having reference cursor 84 and measurement cursor 85 superimposed thereon although as noted earlier herein, one cursor may be used that is functionally equivalent to cursors 84 and 85. Similarly, lower camera 50 is positioned such that its field of view is directed to the lower portion of reference pipe 80 and second calibration rod 88 having a plurality of marking 89 thereon held adjacent to pipe 80. The view from lower camera 50 is displayed on display 58 having reference cursor 92 and measurement cursor 93 superimposed thereon. Lower camera 50 and display 58 may be the same as those used in measuring the length of pipe located in mousehole 38 as just described, or may be a separate third camera if it is desired to leave the mousehole camera undisturbed in order, for example, to preserve the mousehole calibration. In an alternate embodiment, both the view from upper camera 52 and the view from lower camera 50 may be displayed on a single display in a split screen format, or alternately on the same display on command.

In calibrating first upper camera 52, reference cursor 84 is placed on or adjacent to the lowest marking 83 on upper calibration rod 82 as shown in FIG. 5. Since reference cursor 84 will remain in this position for all subsequent measurements, care should be taken that the position of reference cursor 84 will be below the top end of each joint that is planned to be measured when it is added to drillstring 34. Next, measurement cursor 85 is placed on the next marking 83 up from the lowermost marking. An entry is then made into computer 64 via control console 63 and measuring device 56 that records the pixel distance between cursors 84 and 85, and also the length that this pixel distance is equal to, e.g., 0.5 feet (15.25 cm). After this entry has been made, measurement cursor 85 is moved up along each successive marking 83 on upper calibration rod 82 with an entry being made into computer 64 for each marking such that a pixel distance versus length table is generated and stored inside computer 64. In the final calibration step, measurement cursor 85 is placed adjacent to the top edge of reference pipe 80 as shown in FIG. 5. Based on the pixel distance versus length table stored in computer 64, the pixel distance between reference cursor 84 and measurement cursor 85 is converted into length with this length "F" as indicated on display 90 being stored in computer 64 for future use as will be hereinafter explained.

The calibration of lower camera 50 is done in essentially the same manner as with upper camera 52 by using lower calibration rod 88, reference cursor 92, and measurement cursor 93 except that the final calibration step records the pixel distance between reference cursor 92 and measurement cursor 93 when the later is placed adjacent to the lower edge of reference pipe 80 as shown on display 58 in FIG. 5. This pixel distance is converted into a length based on the pixel distance versus length table generated for lower camera 50 and stored in computer 64. This length "G" as indicated on display 58 is stored in computer 64 for future use as will be hereinafter explained.

Figure 6:
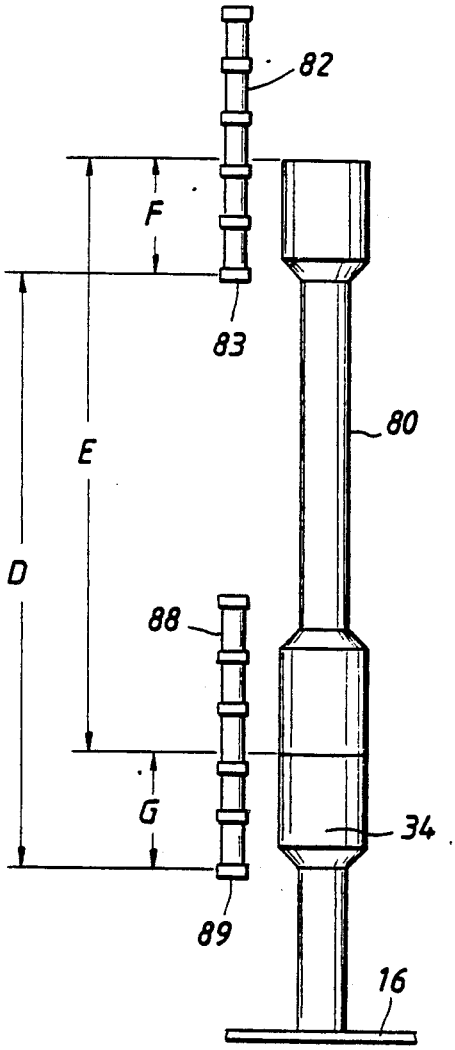
FIG. 6 is a schematic side view of a drill pipe joint suspended in a rig and showing the lengths to be determined by a preferred embodiment of a system and method of the present invention.

FIG. 6 illustrates how length "D" between lowest marking 89 on lower calibration rod 88 (which corresponds to reference cursor 92), and lowest marking 83 on upper calibration rod 82 (which corresponds to reference cursor 84), is determined, length D being needed to compute the length of a new joint being added to or subtracted from drillstring 34 during the measurement procedure. As noted previously, total length "E" of reference pipe 80 was previously measured by using any accurate technique and entered into computer 64. Length F between lowermost marking 83 on rod 82 (where reference cursor 84 is fixed) and the top edge of reference pipe 80 was measured and recorded during the calibration procedure and is therefore also known. Similarly, length G between lowermost marking 89 on rod 88 (where reference cursor 92 is fixed) and the lower edge of reference pipe 80 was also measured and recorded during the calibration procedure and is therefore also known. Length D therefore is equal to length E plus length G minus length F. Once length D is determined in this fashion and stored in computer 64, the length of any new pipe joint added to or subtracted from drillstring 34 can be determined from the equation: unknown pipe length = length D (known) − length G (to be determined) + length F (to be determined), lengths G and F being determined in the following manner.

Figure 7A:
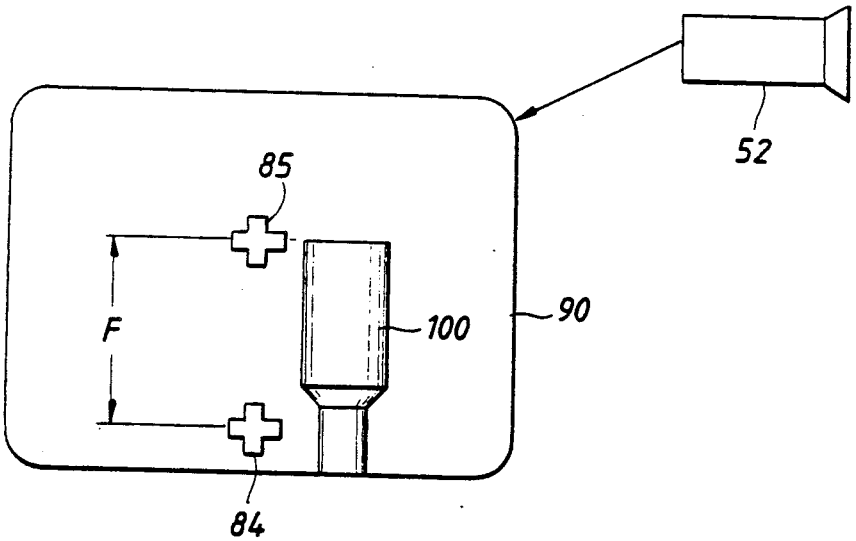
FIG. 7 is a schematic side view of a drill pipe joint suspended in a rig and showing images of the upper and lower ends thereof as recorded on two displays.
Figure 7C:
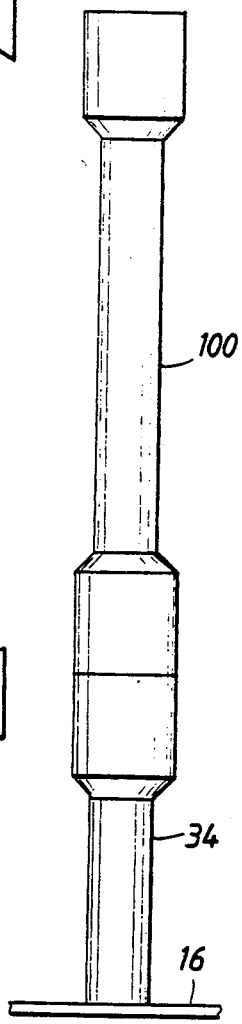
Figure 7B:
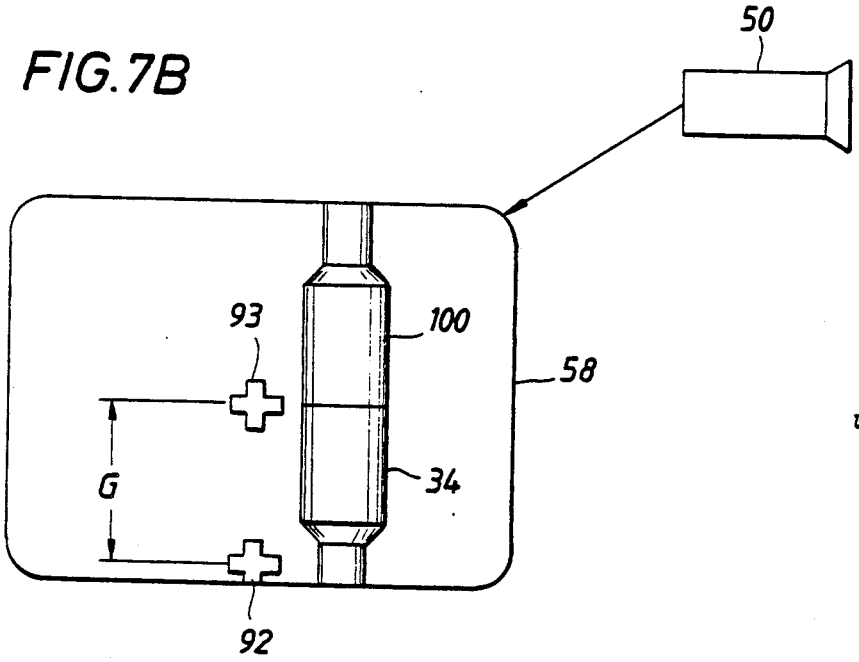

After the calibration procedure of upper camera 52 and lower camera 50 is complete, the video system of the present invention is ready to determine and record the length of any joint being added to or subtracted from drillstring 34, this procedure being illustrated in FIG. 7. In FIG. 7, lower camera 50 records the lower portion of unknown pipe 100 and displays this view on display 58. Measurement cursor 93 is placed adjacent to the lowermost edge of unknown pipe 100 (uppermost edge of drillstring 34) with reference cursor 92 remaining where it was placed and fixed during the earlier-described calibration procedure. An entry is made in control console 63 which instructs computer 64 via measuring device 56 to compute length G based on the pixel distance versus length table generated and stored in computer 64 during the calibration procedure. Similarly, with the view of the upper section of unknown joint 100 displayed by upper camera 52 on display 90 (or on display 58 in a split-screen format), measurement cursor 85 is placed adjacent to the uppermost edge of unknown pipe 100 with reference cursor 84 remaining where it was placed and fixed during the calibration procedure. An entry is made into control console 63 which instructs computer 64 via measuring device 56 to compute length F based on the pixel distance versus length table generated and stored in computer 64 during the calibration procedure. Once lengths F and G are determined in this fashion, computer 64 computes the length of unknown pipe 100 according to the equation: unknown length $=D-G+F$. This known length is then stored in computer 64 and used in adding or subtracting the lengths of all pipes that have been added to or subtracted from drillstring 34 either while the drilling operation is being conducted, or while tripping in or out of the well. In an alternate embodiment, the calibration and measurement procedures may be performed in a digitized format as was described earlier in conjunction with the mousehole embodiment.

Figure 8:
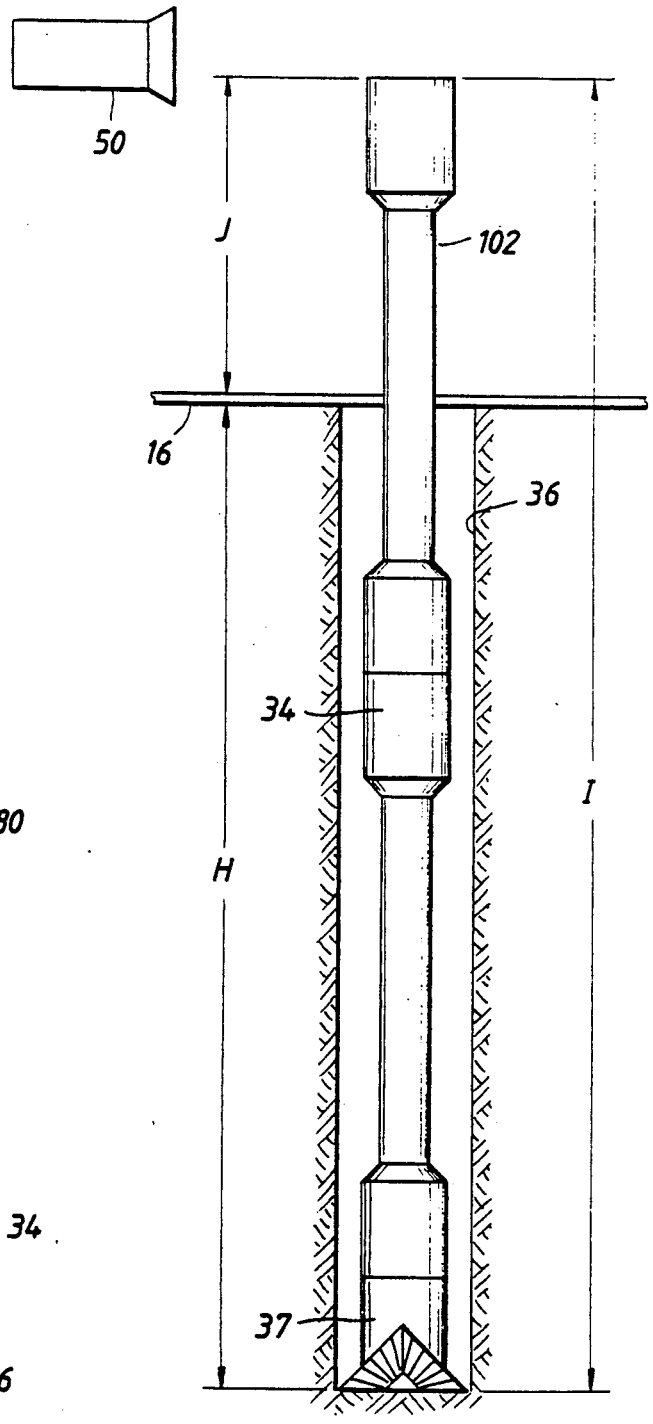
FIG. 8 is a schematic side view of a drill string extending down into a borehole and showing the lengths thereof to be determined by a preferred embodiment of a system and method of the present invention.

In particularly preferred embodiments, the video systems and methods of the present invention find particular use in determining and verifying the depth at which a component of a BHA, e.g., the drill bit or a particular sensor of an LWD sub, is located at any given moment in a wellbore in order to, for example, reset BHA position, reset traveling block position, determine maximum bit penetration, and measure incremental bit penetration. Referring to FIG. 8, there is shown in simplified form drillstring 34 extending below rig floor 16 and into borehole 36. Drillstring 34 includes BHA 37 at its lower end and portion 102 of the last measured pipe added to drillstring 34 extending above rig floor 16. Camera 50 is positioned such that its field of view is directed to the portion 102 of drillstring 34 extending above rig floor 16. Camera 50 may be the same camera as that used to measure the length of a pipe placed within the mousehole as described earlier herein in conjunction with FIGS. 3 and 4, or another camera if it is not possible to focus in on both the mousehole and immediately above the rotary table. In the alternative, camera 50 may be the same as lower camera 50 used in determining the length of a joint added to drillstring 34 as described earlier herein in conjunction with FIGS. 5–7. In whatever case, a pixel distance versus length table (hereinafter referred to as the "rotary table calibration table") is generated and stored in computer 64 by following the calibration procedure as described earlier herein, and the table is used in determining the depth of BHA 37 at any given time in the following manner.

In FIG. 8, depth "H" at any given time in borehole 36 is simply the summation of length "I" (the overall length of drillstring 34) minus length "J" (the length of section 102 extending above rig floor 16). Length I is determined by following the calibration, measurement, and summation procedures described earlier herein by using the one-camera technique of measuring the length of a pipe when it is in the mousehole before being connected to drillstring 34, or the two-camera technique of measuring the length of a joint while it is suspended in mast 12. Length J of portion 102 of drillstring 34 extending above rig floor 16 is determined by following the same basic calibration and measurement technique used for measuring length C of pipe 40 extending out of mousehole 38, which was described earlier herein in conjunction with FIGS. 3 and 4 and therefore believed unnecessary to be repeated. Once length J is determined by computer 64 through the use of the rotary table calibration table, computer 64 determines the depth H at which BHA 37 is positioned by subtracting length J from the summation of all lengths, or length I.

The ability to accurately determine the depth of BHA 37 at any given moment in time as shown in FIG. 8 is particularly useful in verifying and resetting block position and depth as recorded by a block position sensor/-hookload sensor type of depth system used in association with the video systems of the present invention. For example, if drillstring 34 is placed "in-slips" as shown in FIG. 8 whether during a drilling or tripping operation, the video system of the present invention can determine depth H as just described and compare that depth with that indicated by the traveling block movement sensor 27 and hookload sensor 21. In a particularly preferred embodiment of the present invention as shown in FIG. 2, signals from traveling block movement sensor 27 and hookload sensor 21 are sent to computer 64, which continuously compares the depth indicated by sensors 27 and 21 with that determined by the procedure indicated in FIG. 8. If a discrepancy exists, computer 64 automatically or on command resets the position of the traveling block as indicated by sensors 27 and 21, which as noted earlier herein, is a major shortcoming of prior systems in that resetting block position is a slow and disruptive process.

Figure 9:
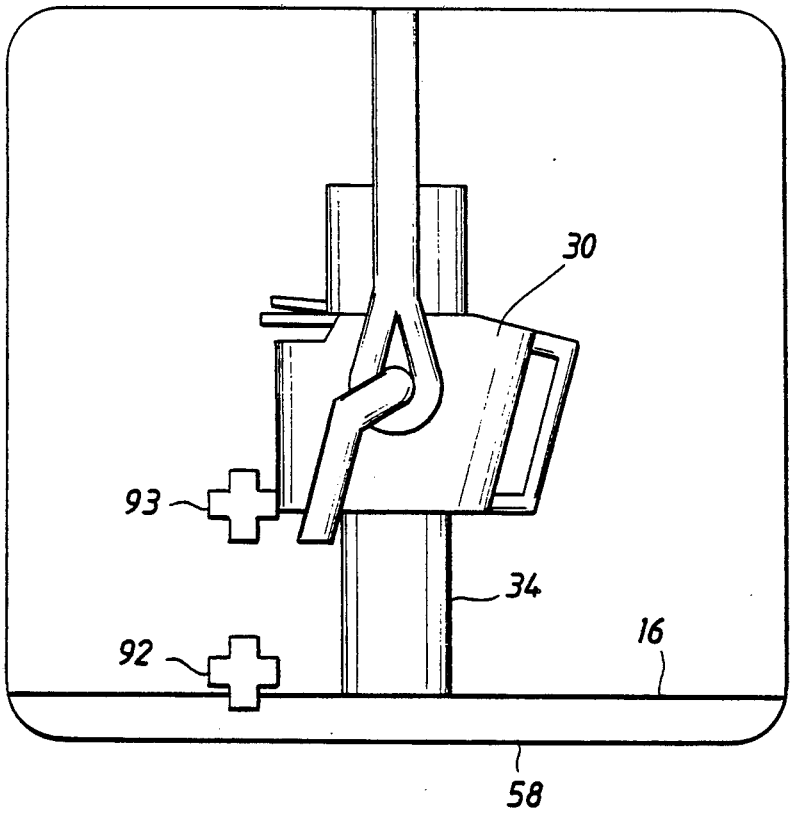
FIG. 9 is a schematic view of an image appearing on a display showing a side view of the top portion of a drillstring being grasped by a rig's elevators.
Figure 10:
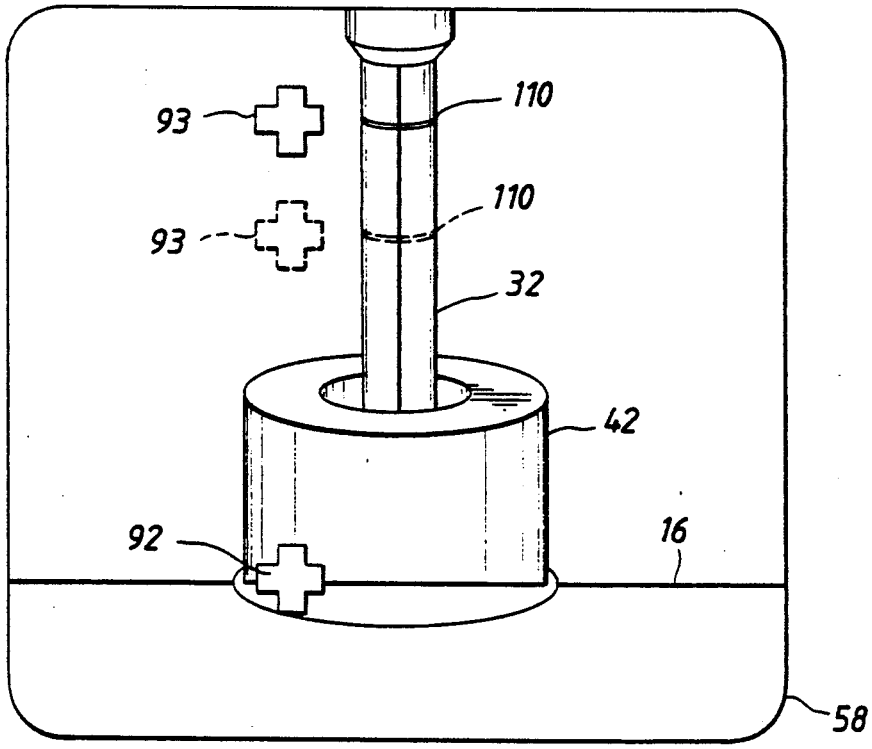
FIG. 10 is a schematic view of an image appearing on a display showing a side view of a rig's rotary table and the kelly extending through the rotary bushing.

FIG. 9 illustrates how one embodiment of the present video system can be used in resetting block position in an alternate manner. In FIG. 9, lower camera 50 (FIG. 8) displays an image on display 58 of the top portion of drillstring 34 being grasped by elevators 30 with reference cursor 92 and measurement cursor 93 superimposed on this image by measuring device 56. Reference cursor 92 is fixed in the same position it was placed when the rotary table calibration table was generated, and measurement cursor 93 is placed adjacent to the lowermost edge of elevators 30, which is the preferred reference point. Based on the rotary table calibration table, computer 64 converts the pixel distance between cursors 92 and 93 to an actual length. This distance between the lowest point of elevators 30 and rig floor 16 is the same as (or a known distance from) the traveling block altitude. If this newly measured distance varies from that indicated by traveling block position sensor 27, computer 64 either on command or automatically resets block position. FIG. 10 illustrates a method of an embodiment of the present invention that is used in measuring incremental bit movement and in determining maximum bit penetration. In FIG. 10, incremental bit movement is measured by placing measurement cursor 93 adjacent to a mark 110 on kelly 32 with reference cursor 92 remaining in its calibration position (i.e., on rig floor 16). The length corresponding to the pixel distance between cursors 92 and 93 is measured by computer 64 with the rotary table calibration table. After a period of drilling time, kelly 32 will have move downward, for example, to where mark 110 on kelly 32 is shown in phantom. At that time, measurement cursor 93 (shown in phantom) is moved adjacent to mark 110 on kelly 32 and the distance between cursors 92 and 93 is again measured. The difference between the two measurements is the amount of bit penetration, which is recorded as such by computer 64. In a preferred embodiment, the bit penetration is added to the previously-measured and determined sum of the lengths of all the pipe in the borehole to give BHA depth at any given moment in time. In a particularly preferred embodiment, computer 64 is provided with a clock or timing circuitry means which records bit penetration versus time to yield rate of penetration, which is a valuable parameter to the operator of the drilling rig.

The systems and methods of the present invention can be further used in conjunction with block position sensor 27 and hookload sensor 21 in accurately determining depth while drilling, tripping-in, or tripping-out, all as shown operationally in FIG. 2. Hookload is monitored to determine when traveling block movement, as monitored by traveling block position sensor 27, can be equated to drillstring or BHA movement. In general, a high hookload indicates that the drillstring is supported by the traveling block, i.e., the string is out-of-slips, and therefore movement of the traveling block can confidently be equated to drillstring movement. A low hookload indicates that the drillstring is supported by the slips, i.e., the string is in-slips, and therefore movement of the traveling block should not be equated to drillstring movement.

Hookload sensors are typically hydraulic or load cell driven and are commonly placed on or near the deadline anchor. Unfortunately, using hookload sensors in determining the slips-in versus slips-out transition is somewhat inaccurate with most of the inaccuracies arising because of delays imposed on the hookload sensor signal. For example, delays are imposed by the mechanics of the hydraulic system or the electronics of the load cell, and the mechanics of the cable as it stretches and contracts. There are also delays induced by electrical and electronic components of the data acquisition circuitry, both intentional and parasitic. These delays and their magnitude, which typically vary from sensor to sensor and rig to rig, adversely affect hookload measurements because they mask the slips transition point, i.e., the exact point at which the drillstring and BHA start moving when taken out-of-slips. This problem is made more acute at slips transition points because both traveling block position and hookload are typically changing rapidly.

Hookload measurements can also vary appreciably because the drillstring is typically suspended at the end of more than a thousand feet of cable. This cable stretches and acts like a spring whenever the drawworks plays out or takes in cable, which causes momentary overshoots and undershoots on the hookload signal that are more a function of driller or rig action than string weight.

Friction of the string against the formation, especially in a deviated well, can also cause overshoots and undershoots in hookload during movement, depending on whether the string is going in out of the hole. These false drops and rises during movement can also occur in a well that has both high mud weight and a bit with small jets. False hookload measurements can also occur in a string that is stationary because some of the string weight can be supported by the formation wall in the case of a deviated well, and/or by the formation itself when the bit is on-bottom. In addition, the accuracy of hookload sensors, especially hydraulically driven ones, are susceptible to temperature changes such as those caused by changes in sunlight patterns or precipitation.

Traveling block movement sensors are usually up/-down counters and are commonly placed on the drawworks or the fast sheave in the crown block. There are also cable movement sensors, also mounted in the crown block or near the drawworks, that can be used to determine block movement and position. When placed on the drawworks, they actually function as a drawwork position sensor. In all cases, a calibration must be performed to relate drawworks movement or cable movement to traveling block movement or position. This is typically done by positioning the traveling block at its lowest point and setting the drawworks position in a computer. A series of periodic measurements of block height and corresponding drawworks position are then made at certain prescribed intervals as the drawworks turns, thereby taking in cable and raising the traveling block. When the block is at its highest position, the calibration procedure is complete and these drawworks-position/block-height coefficients make up a table that is used to relate drawworks position to block height. When the traveling block sensor is placed on the fast sheave in the crown block, a conversion is preformed based on sheave diameter so that sheave rotation can be equated to drawworks movement. Since sheave diameter is constant, only initial block position needs to be entered and then traveling block position can be tracked.

The drawworks cable is subject to both elastic and plastic stretch when under tension. Elastic stretch is temporary, i.e. the cable returns to its previous length when tension is removed. Since the cable wraps over the drawworks drum in several layers, the relationship between drawworks position and block altitude is neither constant nor linear. These layers are applied at different times under different hookloads (different tension) and therefore the cable does not always change layers at the same exact place with respect to block position. The effects of plastic stretch, which typically occur with a new cable or when a cable is subjected to a higher then normal stress, are not removed with a reduction in tension. Therefore, drawworks calibrations should be preformed whenever the cable is replaced, after new cable has been "worked in", and whenever the cable has been subjected to excessive loads such as after the freeing of a stuck drill string.

A rotation sensor mounted on the dead sheave can be used to detect cable stretch because the dead sheave only moves an amount proportional to cable stretch. However, a cable stretch sensor adds a third sensor to the cost of the system, does not address the cable slippage problem, is subject to fouling, and is difficult to install and maintain because it is located at the top of the derrick.

Cable movement sensors can also be used to determine block movement. These sensors typically detect cable movement by sensing the strands on the cable through hall effect sensors or some other means. They basically preform the same as, and have the same drawbacks as, sheave sensors. That is, they are expensive, difficult to install and maintain, and are subject to fouling.

In using the present video system and methods in conjunction with a conventional hookload/block position depth system, two hookload thresholds are preferably used to provide hysteresis in the slips transition determination algorithm programmed within computer 64. An in-slips threshold is selected low enough such that whenever hookload is below the threshold, it may be confidently assumed that the string is definitely in-slips. An out-of-slip threshold is selected high enough such that whenever hookload is above the threshold, it may be confidently assumed that the string is definitely out-of-slips. Hookload must pass through both thresholds before a slips transition can be said to have occurred.

FIG. 11 illustrates the operation of a hookload monitoring method used in conjunction with the video systems of the present invention that employs hysteresis. The top graph of FIG. 11 illustrates hookload 112 versus time while the lower graph illustrates traveling block position or traveling block altitude (TBA) 115. In FIG. 11 in conjunction with FIG. 2, computer 64 scans the hookload signal 112 imputed to computer 64 from hookload sensor 21 at a rate sufficient to ensure the necessary accuracy and resolution. Computer 64 saves each hookload measurement as well as the corresponding block position measurement 115 from block position sensor 27 in a buffer. This buffer preferably contains a sufficient number of samples so that when a slips transition occurs, computer 64 is able to scan back through the buffer and find the block position corresponding to the hookload value at the previous threshold.

During an in-slips transition, hookload 112 can be seen to fall through the out-of-slips threshold at point 113 and then through the in-slips threshold at point 114 at which time drillstring 34 is firmly in-slips. Block position 115 also falls during this time since the traveling block is being lowered as drillstring 34 is being placed in-slips. Computer 64 scans the hookload samples stored within the buffer back from point 114 until it finds point 113, which is above the out-of-slips transition threshold. At point 113, computer 64 takes the corresponding block position at point 116 as the point where the drillstring stopped moving.

The dynamics of an out-of-slips transition is different from those of an in-slips transition because the bit does not start moving until the hookload is above the out-of-slips threshold. Computer 64 monitors hookload 112 as it rises above the in-slips threshold at point 117 and then to out-of-slips threshold at point 118. At this time, computer 64 selects block position 115 at point 119, which corresponds to point 118 of hookload 112 as the point the bit started moving. Computer 64 then uses in-slips block position 116 subtracted from out-of-slips block position 119 and equates this the length of the pipe just added to or subtracted from drillstring 34.

Incremental depth measurements while the drillstring is out-of-slips are usually quite accurate in a properly functioning hookload/cable movement type depth system. Errors usually occur during slips transitions, and these errors are usually small. Unfortunately, these errors accumulate and over a period of time can become significant, well over several feet in a trip-in or trip-out operation. The second source of inaccuracy typically occurs in measuring the length of pipe added to or subtracted from the drillstring by the hookload/drawworks measurement routine. Since the primary purpose of these pipe measurements is a check of the driller's manual tally, this check should be more accurate and reliable than the measurement it is being used to verify.

A particularly preferred embodiment of the present invention significantly improves the depth measurement algorithms with the addition of a rig calibration algorithm. It also has a video measurement capability to provide frequent depth resets that eliminate the accumulation of depth errors. This video based measurement is independent of conventional sensors, and does not interrupt or affect the normal drilling operation of the rig or its crew.

The Rig Calibration Algorithm of the present invention uses the same hookload/traveling block position pairs saved by the just described measurement algorithm and adds two offsets called the In-Slips Look Back (ISLB) and the Out-of-Slips Look Back (OSLB). These offsets are used by the hookload/TBA measurement algorithm to calibrate the hookload/block position measurement.

In calibrating a rig, a reference pipe being added to the drillstring is first accurately measured with a tape or with the video systems and methods described earlier herein. This pipe becomes a reference for use by the rig calibration algorithm. The reference pipe is subsequently added to the drillstring and the length thereof measured by the hookload/TBA measurement algorithm. If the length of the reference pipe as measured by the measurement algorithm is not the same as that actually measured manually or by video, the operator can select a ISLB offset and/or an OSLB offset so that length of the pipe is indeed accurately determined by the measurement algorithm. This same offset is then applied to all subsequent measurements automatically.

FIG. 12 and accompanying Table 1 illustrate an example of the calibration process where only an out-of-slips look back is used, the in-slips look back being essentially identical in principle and therefore believed not necessary to be also described in detail. Samples taken by the software are numbered on the graph of hookload 112 versus time and shown in Table 1 along with corresponding traveling block altitudes (TBAs). In the example, a reference pipe is measured as 30.00 feet (9.14 m) and in-slips TBA of 45.92 feet (14.00 m) is recorded. ISLB and OSLB are both initially set at zero. The out-of-slips threshold (OST) is set at 90 Klbs (40.8 KKG).

At sample #6, hookload is 91 Klbs (41.3 KKG) which is above the OST threshold of 90 Klbs (40.8 KKG). The string is now out-of-slips and the measurement algorithm looks back in time at each sample until it finds one at or below the OST of 90 Klbs. Sample 5 is 89 lbs (40.4 KKG), which is below the OST. At this point, the out-of-slips TBA is 74.98 feet (22.85 m).

The in-slips TBA was measured during the previous transition and was 45.00 feet (13.72 m) and therefore the length of the pipe is out-of-slips TBA (75.98 ft. (23.16 m)) minus in-slips TBA (45.92 feet (14.00 m)) or 30.06 ft (9.16 m), which is 0.06 ft longer than the reference pipe actually is. The operator therefore adjusts the OSLB to correspond to sample #3 which has an out-of-slips TBA of 75.92 (23.14 m). After making this OSLB adjustment, the length of the pipe as computed by the measurement algorithm is the out-of-slips TBA as OSLB adjusted (75.92 ft/23.14 m), minus the in-slips TBA (45.92 ft/14.00 m)=30.00 feet (9.14 m). Now every time the measurement software steps back through the trace buffer it will look back an extra three times (the out-of-slips look back OSLB) to obtain the out-of-slips TBA.

In a particularly preferred embodiment of the present invention, the video measurement allows bit position to be checked and reset at frequent intervals, thereby preventing the accumulation of depth errors. Bit position can be reset when drillstring 34 is in-slips and a portion of the string, called the stem, extends above the rig floor. Bit position can also be reset while drilling and the kelly is fully extended into the hole.

The video system also measures pipe independent of the hookload/block position sensors. This video measurement can be used to resolve discrepancies between the driller's and the hookload/block position sensor measurement. Also, since all pipe is preferably videotaped while going into the hole, the tape can be reviewed at a later time to construct a complete depth-versus-time log or to resolve specific depth anomalies. The video system can also be used to reset the traveling block position should it get out of calibration. Block position must be known at all times because it is the basis of both incremental bit position and hookload/-block position measurements.

Figure 13A:
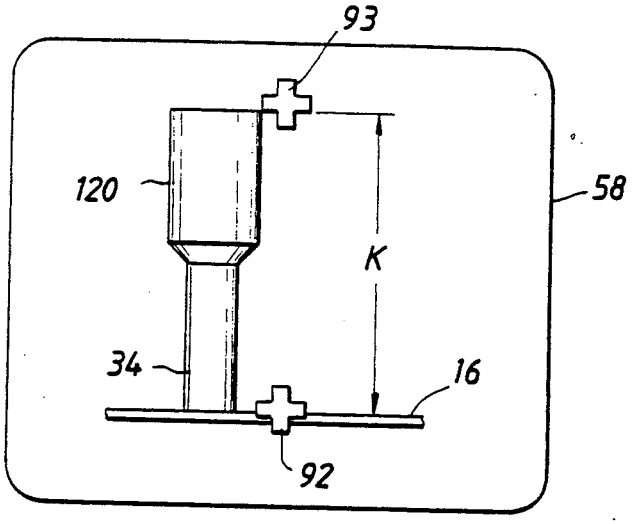
FIG. 13A is a schematic view of an image recorded on a display showing a side view of the top portion of a drillstring extending above a rig floor.
Figure 13C:
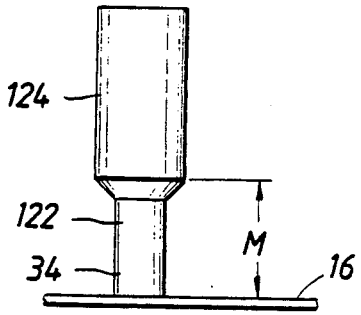
FIG. 13C is a schematic side view of the joint of FIG. 13B after a substantial portion thereof has been lowered into the wellbore.
Figure 13B:
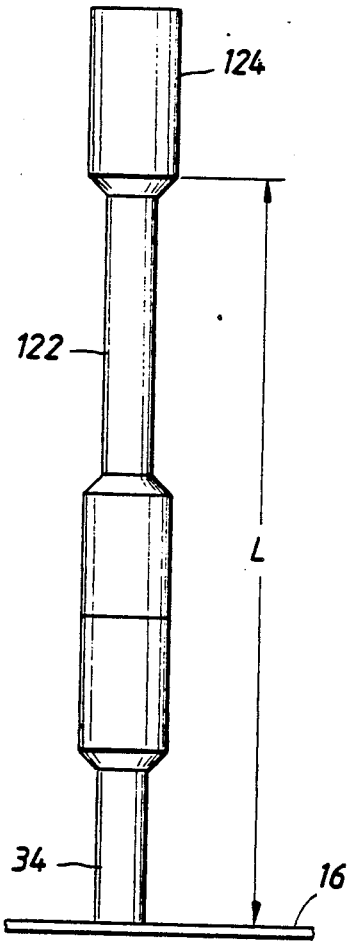
FIG. 13B is a schematic side view of a joint having been added to the top portion of the drillstring appearing on the display of FIG. 13A.

FIGS. 13A–13D illustrate a method of a preferred embodiment of the present invention that uses the previously-described video rig floor calibration and measurement procedures in conjunction with block movement sensor 27 and hookload sensor 21 (shown in FIGS. 1 and 2) to determine depth while tripping in. In FIG. 13A, the trip-in procedure begins by measuring the height "K" of portion 120 of drillstring 34 extending above rig floor 16 as shown on display 58 having cursors 92 and 93 superimposed thereon. All of the video measurements are made while the string is in-slips to ensure the string is motionless. In FIG. 13B, new joint 122, either a single, double, or triple, is added to drillstring 34, and string 34 is taken out of slips. The out-of-slips block altitude "L" as indicated in FIG. 13B is measured by block movement sensor 27. Height L is shown referenced to the lower edge of box 124 of joint 122 because this is the point the elevators contact the string. Actual block height as recorded by block movement sensor 27 may not be this exact point but will always be a constant distance from this point. Because of that constant distance relationship, block height distance differences cancel out.

Figure 13D:
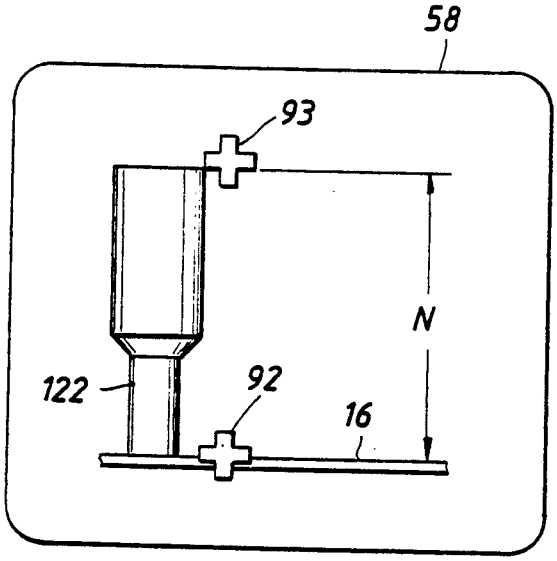
FIG. 13D is a schematic view of an image recorded on a display showing the joint of FIG. 13C extending above the rig floor.

Referring to FIG. 13C, drillstring 34 is placed in-slips once new joint 122 has been lowered into the wellbore and the in-slips block height M is measured by block position sensor 27. In FIG. 13D, camera 50 displays the top portion of joint 122 on display 58. Measurement cursor 93 is placed at the top edge of joint 122 with reference cursor 92 in its reference position. Computer 64 calculates height "N", the length of the portion of joint 122 extending above rig floor 16, using the rig floor calibration table. The length of added pipe 122 is the out-of-slips block height L minus the start height K plus the end height N minus the in-slips block height M.

Figure 14:
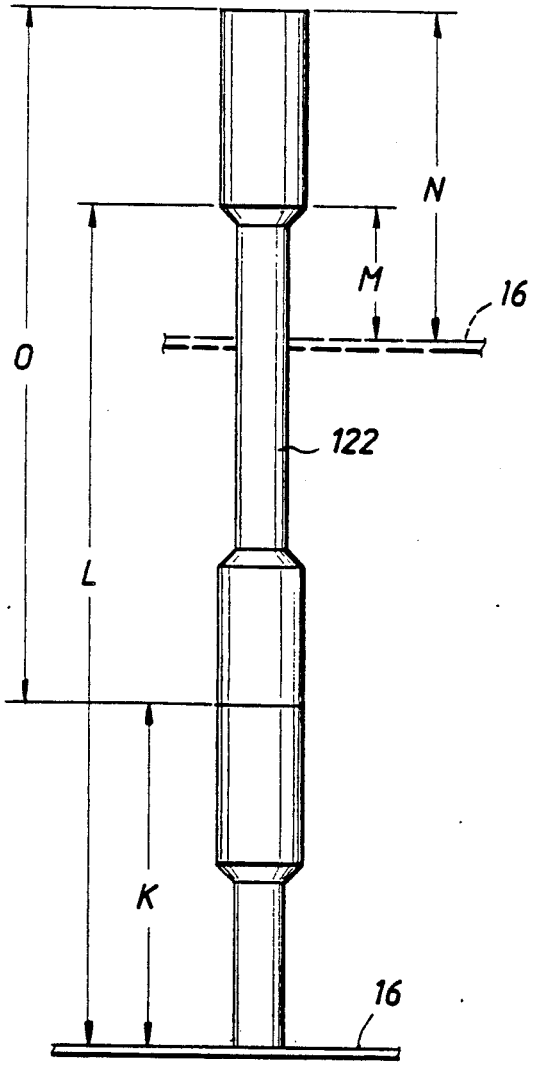
FIG. 14 is a schematic side view of the joint of FIGS. 13A–13D and the lengths to be determined by the systems and methods of the present invention.

FIG. 14 illustrates a composite of the above measurements showing rig floor 16 before pipe 122 is added, and rig floor 16 (shown in phantom) after the pipe is added. The length "O" of joint 122 is equal to the out-of-slips block height L minus the video-measured start height K plus the video-measured end height N minus the in-slips block height M.

Figure 15A:
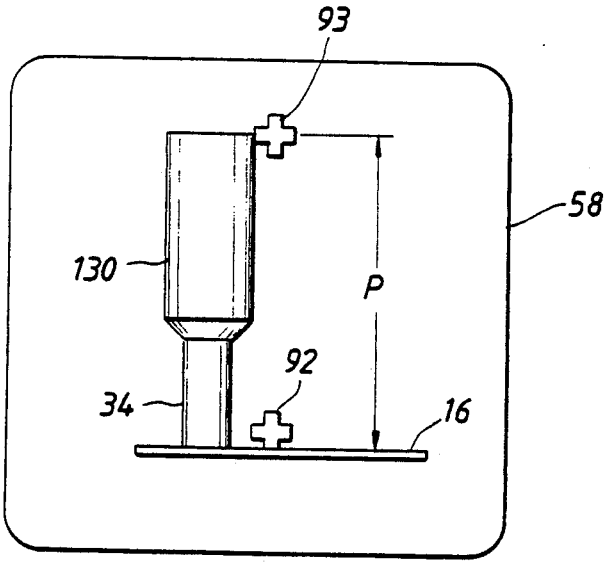
FIG. 15A is a schematic view of an image recorded on a display showing a side view of the top portion of a drillstring extending above a rig floor.

FIGS. 15A–15D illustrates the method of a preferred embodiment of the present invention that uses the rig floor video measurement system in conjunction with block position sensor 27 and hookload sensor 21 to measure joints while tripping out. In FIG. 15A, the trip-out measurement procedure begins by measuring the height "P" of portion 130 of drillstring 34 extending above rig floor 16 as recorded by camera 50 and displayed on display 58. All of the video measurements are preferably made while the string 34 is in-slips to ensure the string is motionless.

Figure 15C:
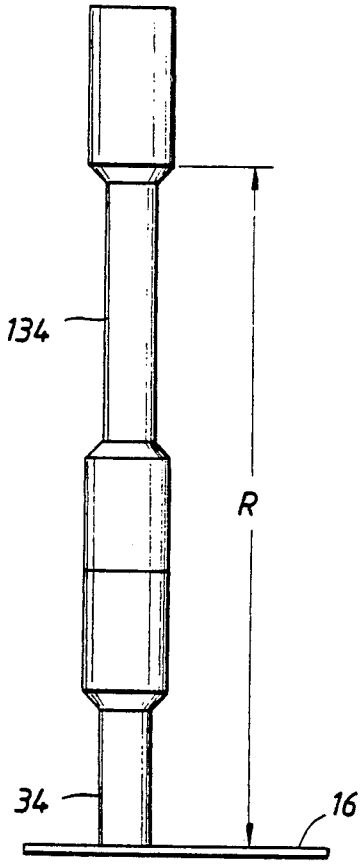
FIG. 15C is a schematic side view of a joint having been pulled out of a wellbore.
Figure 15B:
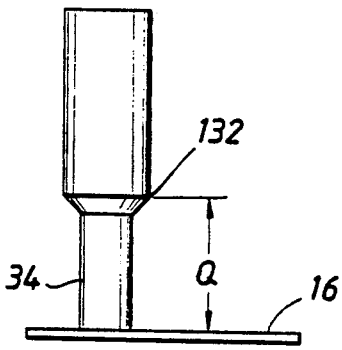
FIG. 15B is a schematic side view of the top portion of the drillstring appearing on the display of FIG. 15A

Referring to FIG. 15B, the out-of-slips block altitude "Q" is measured by the block position sensor 27 and hookload sensor 21 when string 34 is placed out of slips and just before string 34 is raised from the borehole. This height Q is shown referenced to the bottom edge of box 132 because this is the point the elevators contact string 34. Actual block height as recorded by block position sensor 27 may not be this exact point but will always be a constant distance from this point. Because of that constant distance relationship, these block height differences cancel.

Figure 15D:
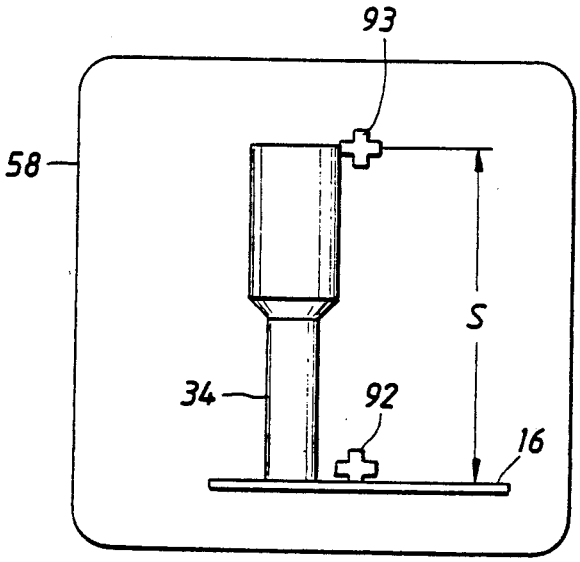
FIG. 15D is a schematic view of an image recorded on a display of the top portion of a drillstring after the joint of FIG. 15C has been removed therefrom.

Referring to FIG. 15C, drillstring 34 is shown raised such that joint 134 to be removed from drillstring 34 extends above rig floor 16. String 34 is placed in-slips and the in-slips block height "R" is measured by block position sensor 27. In FIG. 15D, camera 50 records the top portion of drillstring 34 extending above rig floor 16. Measurement cursor 93 is placed at the top edge of drillstring 34 (which corresponds to the lower edge of removed joint 134) and computer 64 calculates height "S" of the portion of drillstring 34 extending above rig floor 16 using the rig floor calibration table. The length of removed joint 134 is the in-slips block height R minus the video-measured end height S plus the video-measured start height P minus the out-of-slips block height Q.

Figure 16:
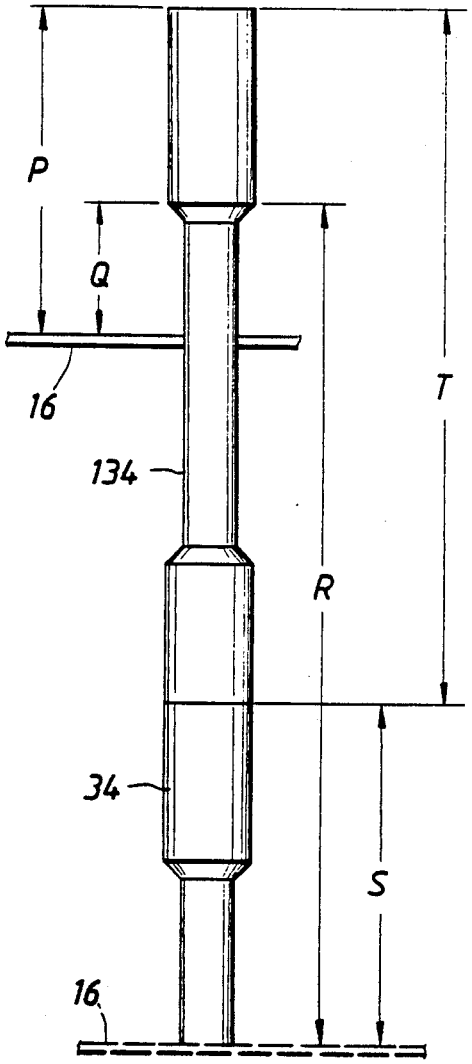
FIG. 16 is a schematic side view of the joint of FIGS. 15A–15D and the lengths to be determined by the systems and methods of a preferred embodiment of the present invention.

FIG. 16 shows a composite of the above measurements showing rig floor 16 before joint 134 is removed from drillstring 34, and rig floor 16 (shown in phantom) after joint 134 is removed. Again, length "T" of joint 134 is equal to the video-measured start height P minus the out-of-slips block height Q plus the in-slips block height R minus the video measured end height S.

The previously-described video depth determination systems and methods are particularly suited for accurately determining depth in conjunction with providing services such as measurements-while-drilling (MWD), logging-while-drilling (LWD), and formation evaluation while drilling (FEWD). In providing such services, downhole parameter sensing tools typically either telemeter information to the surface in "real time," and/or record downhole information in a memory device in an information versus time log for later retrieval and evaluation at surface. In the case of realtime telemetered data, BHA depth as measured and recorded versus time with the systems and methods of the present invention is synchronized with downhole information as it is received at the surface. In the case of recorded data, the downhole recorded information versus time log is retrieved from the LWD tool when it is brought back to surface and sychronized with the depth versus time log recorded by the systems and methods of the present invention to generate a downhole information versus depth log.

Systems and methods for accurately determining depth are thus provided. The systems described and illustrated herein have been somewhat simplified so that a person skilled in the art may readily understand the present invention and incorporate it into any application by making a number of modifications and additions thereto, none of which entailing a departure from the spirit and scope of the present invention. Accordingly, the following claims are intended to embrace such modifications.

What is claimed is :

1. A method of determining the length of an object to be inserted into a wellbore, said method comprising the steps of:

a) displaying an image of said object onto a display having at least one moveable cursor superimposed thereon;

b) generating a table of cursor position on said display versus length;

c) moving said cursor superimposed on said display to points corresponding to said length of said object to be determined;

d) determining the distance between said points; and e) equating said distance between said points to a length from said table, thereby determining said length of said object.

2. The method recited in claim 1 wherein said table of cursor position versus length is generated by the steps of placing calibration means adjacent to where said object is or will be when said length thereof is determined, said calibration means having a plurality of markings thereon spaced a predetermined length from one another; moving said cursor on said display to points corresponding to said markings on said calibration means; and equating said marking points to said predetermined length between said markings, thereby generating said table.

3. The method recited in claim 1 wherein said object is interconnected to a plurality of similar objects and wherein the overall length of said plurality of interconnected objects is determined by the additional step of summing the lengths of each object.

4. A method of determining the depth at which a component of a bottomhole assembly is located within a wellbore, said bottomhole assembly being attached to the lower end of a plurality of objects interconnected to one another, said method comprising the steps of:

a) displaying an image of at least one of said objects onto a display before said object is inserted into said wellbore, said display having at least one moveable cursor superimposed thereon;

b) generating a table of cursor position on said display versus length;

c) moving said cursor superimposed on said video display to points corresponding to the length of said at least one object;

d) determining the distance between said points;

e) equating said distance between said points to a length from said table, thereby determining the length of said at least one object; and f) summing the lengths of said plurality of objects as they are inserted into said wellbore, thereby determining the depth of said component of said bottomhole assembly.

5. The method recited in claim 4 wherein said table of cursor position versus length is generated by the steps of placing calibration means adjacent to where said at least one object will be when said length thereof is determined, said calibration means having a plurality of markings thereon spaced a predetermined length from one another; moving said cursors on said display to points corresponding to said markings on said calibration means; and equating said marking points to said predetermined length between said markings, thereby generating said table.

6. The method recited in claim 4 wherein said object is suspended within a drilling rig mast, and wherein an image is displayed of the top portion and the bottom portion of said object on said display, and wherein step a) through step e) is performed for said top and said bottom portion images.

7. The method recited in claim 4 further comprising the step of:

g) simultaneously with step f), recording the time at which said objects are inserted into said wellbore, thereby generating a depth versus time recording.

8. The method recited in claim 7 wherein said bottomhole assembly includes at least one logging while drilling sensor, and wherein said method further comprises the steps of measuring downhole parameters with said sensor; recording the time at which said measurements were made, and correlating said depth versus time recording with said downhole parameter measurements versus time recording, thereby producing a downhole parameter measurement versus depth recording.

9. The method recited in claim 4 wherein said plurality of objects are inserted into said wellbore with a moveable traveling block suspended from the mast of a drilling rig with the aid of a moveable cable, and wherein means are provided for determining the movement of and load on said cable, said method further comprising the steps of:

g) determining the movement of and load on said cable, h) equating movement of said cable to movement of said component of said bottomhole assembly when said load on said cable exceeds a predetermined amount;

i) in response to equating movement of said cable to movement of said bottom hole assembly component, determining the depth of said bottom hole assembly component in said wellbore; and j) comparing said depth determined in step (i) to said depth determined in step (f) and resetting the depth determined in step (i) to correspond to the depth determined in step (f).

10. An apparatus for determining the length of an object to be inserted into a wellbore, said apparatus comprising:

a) means for generating an image of said object onto a display having at least one moveable cursor superimposed thereon;

b) means for generating a table of cursor position on said display versus length;

c) means for moving said cursor superimposed on said display to points corresponding to said length of said object to be determined;

d) means for determining the distance between said points; and e) means for equating said distance between said points to a length from said table, thereby determining said length of said object.

11. The apparatus recited in claim 10 wherein said means for generating said table includes calibration means having a plurality of markings thereon spaced a predetermined distance from one another.

12. The apparatus recited in claim 10 wherein said apparatus determines the length of a plurality of interconnected objects, said apparatus further comprising means for summing the lengths of each object.

13. An apparatus for determining the depth at which a component of a bottomhole assembly is located within a wellbore, said bottomhole assembly being attached to the lower end of a plurality of objects interconnected to one another, said apparatus comprising:

a) means for displaying an image of at least one of said objects onto a display before said object is inserted into said wellbore, said display having at least one moveable cursor superimposed thereon;

b) means for generating a table of cursor position on said display versus length;

c) means for moving said cursor superimposed on said video display to points corresponding to the length of said at least one object;

d) means for determining the distance between said points;

e) means for equating said distance between said points to a length from said table, thereby determining the length of said at least one object; and f) means for summing the lengths of said plurality of objects as they are inserted into said wellbore, thereby determining the depth of said component of said bottomhole assembly.

14. The apparatus recited in claim 13 wherein said means for generating said table includes calibration means having a plurality of markings thereon spaced a predetermined distance from one another.

15. The apparatus recited in claim 13 further comprising:

g) means for recording the time at which said objects are inserted into said wellbore, thereby generating a depth versus time recording.

16. The apparartus recited in claim 13 wherein said plurality of objects are inserted into said wellbore with a moveable traveling block suspended from the mast of a drilling rig with the aid of a moveable cable, said objects placing a load on said cable, said apparatus comprising:

g) means for monitoring movement of said cable;

h) means for monitoring said load on said cable; and i) means for equating movement of said cable to movement of said bottomhole assembly component when said load on said cable exceeds a predetermined value.

17. The apparartus recited in claim 15 wherein said component of said bottomhole assembly includes means for measuring downhole parameters and the time at which said downhole parameters were made to produce a parameter versus time recording, said apparatus further comprising means for correlating said depth versus time recording to said parameter versus time recording.

18. The apparatus recited in claim 13 wherein said means for generating an image of said object comprises at least one video camera.

19. The apparatus recited in claim 13 wherein said means for superimposing at least one moveable cursor on a display superimposed a reference cursor and a measurement cursor on said display.

20. The apparatus recited in claim 15 wherein said depth versus time recording is recorded simultaneously with said image.

* * * * *